United States Patent [19]

Van Rens

[11] Patent Number: 5,031,685

[45] Date of Patent: Jul. 16, 1991

[54] INTERNAL COMBUSTION ENGINE AND METHOD FOR MAKING THE SAME

[75] Inventor: Russell J. Van Rens, Milwaukee, Wis.

[73] Assignee: Outboard Marine Corporation, Waukegan, Ill.

[21] Appl. No.: 315,900

[22] Filed: Feb. 27, 1989

Related U.S. Application Data

[63] Continuation-in-part of Ser. No. 202,970, Jun. 3, 1988.

[51] Int. Cl.[5] ..... B22C 7/02; B22C 9/04

[52] U.S. Cl. ..... 164/34; 164/246; 164/249

[58] Field of Search ..... 164/34, 35, 36, 45, 164/246, 249

[56] References Cited

U.S. PATENT DOCUMENTS

| | | | |
|---|---|---|---|
| 3,635,280 | 1/1972 | Parsons | 164/246 |
| 3,830,285 | 8/1974 | Schrader, Jr. | 164/249 |
| 4,632,169 | 12/1986 | Osborn et al. | 164/34 |
| 4,777,997 | 10/1988 | Corbett | 164/34 |
| 4,802,447 | 2/1989 | Corbett | 123/65 K |

FOREIGN PATENT DOCUMENTS

| | | |
|---|---|---|
| 215616 | 3/1987 | European Pat. Off. . |
| 227308 | 7/1987 | European Pat. Off. . |
| 2055423 | 3/1981 | United Kingdom . |
| 2175523 | 12/1986 | United Kingdom . |

*Primary Examiner*—Richard K. Seidel

*Attorney, Agent, or Firm*—Michael, Best & Friedrich

[57] ABSTRACT

A foam pattern assembly for use in forming an engine block in a lost foam casting process, the pattern assembly comprising a base portion including a generally planar front mounting surface having therein a plurality of crankcase-defining cavities and a plurality of intake ports, and a rear mounting surface spaced from the front mounting surface, the base portion partially defining a plurality of transfer passages and a plurality of air intake passages each communicating between a respective one of the intake ports and a respective one of the transfer passages, and a cylinder portion including a generally planar front mounting surface mating with the rear mounting surface on the base portion, the cylinder portion partially defining the air intake passage and partially defining a plurality of cylinder bores each communcating with a respective one of the transfer passages.

50 Claims, 14 Drawing Sheets

10
45
318
44
44
262
34
38
42
46
50
43
43
174
170
206
158
147
162
150
178
142
210
146
154
166
18
138
140

306
10
294
284
318
262
24
21
50
20
18
46
21
24
170
42
147
15
158
174
206
20
210
16
178
150
162
23
22
22
142
22
106
166
154
134
28
130
16
22
15
126
22
18
138
140

Fig. 10
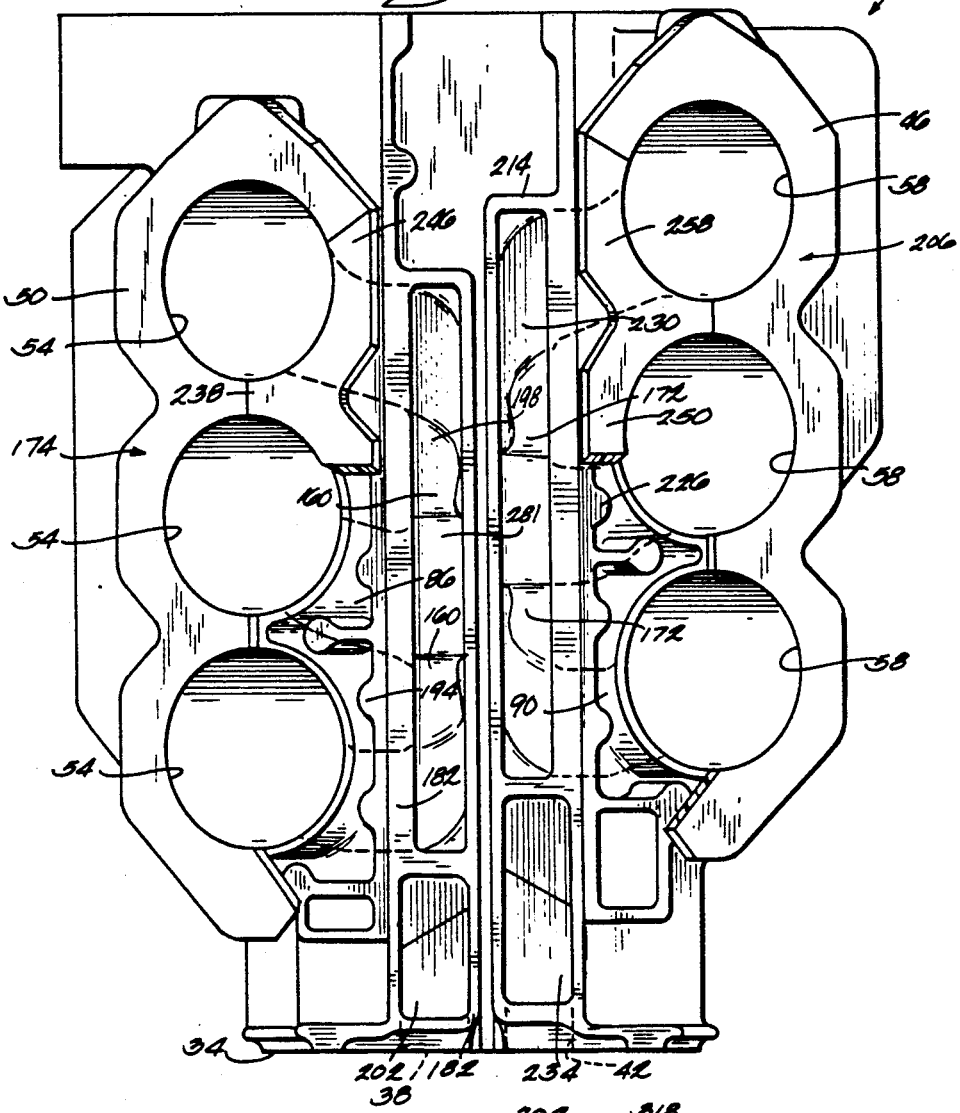
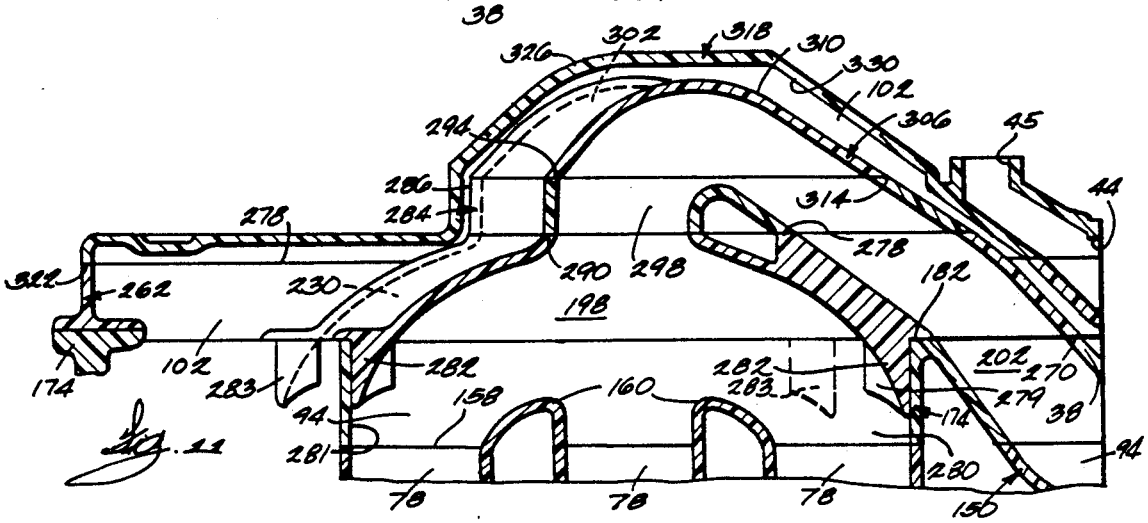
Fig. 11

INTERNAL COMBUSTION ENGINE AND METHOD FOR MAKING THE SAME

RELATED APPLICATIONS

This is a continuation-in-part, of Ser. No. 202,970, filed June 3, 1988, now allowed.

Attention is directed to Ser. No. 202,212, filed June 3, 1988, now abandoned.

BACKGROUND OF THE INVENTION

The invention relates to internal combustion engines, to lost foam casting processes and to methods for making internal combustion engines with lost foam casting processes. More particularly, the invention relates to foam pattern assemblies for making V-type engine blocks in lost foam casting processes.

SUMMARY OF THE INVENTION

The invention provides a foam pattern assembly for use in forming an engine block in a lost foam casting process, the pattern assembly comprising a base portion including a generally planar front surface having therein a plurality of crankcase-defining cavities and a plurality of intake ports, and a rear mounting surface spaced from the front surface, the base portion partially defining a plurality of transfer passages and a plurality of air intake passages each communicating with a respective one of the intake ports, and a cylinder portion including a generally planar front mounting surface mating with the rear mounting surface on the base portion, the cylinder portion partially defining the air intake passages and partially defining a plurality of cylinder bores each communicating with a respective one of the transfer passages.

The invention also provides a foam pattern for use in forming an engine block in a lost foam casting process, the pattern comprising a base portion including a mounting surface having therein a plurality of crankcase-defining cavities, the base portion at least partially defining a plurality of air intake passages each communicating with a respective one of the crankcase-defining cavities.

The invention also provides a foam pattern for use in forming an engine block in a lost foam casting process, the pattern comprising a cylinder portion partially defining a plurality of cylinder bores, a plurality of transfer passages each communicating with a respective one of the cylinder bores, and a plurality of air intake passages each communicating with a respective one of the transfer passages.

The invention also provides a foam pattern assembly for use in forming an engine block in a lost foam casting process, the pattern assembly comprising a base Portion including a generally planar front surface having therein a plurality of crankcase-defining cavities, a first rear mounting surface spaced from the front surface, and a second rear mounting surface spaced from the front surface, a first front cylinder portion including a generally planar front mounting surface mating with the first rear mounting surface on the base portion, the first front cylinder portion partially defining a plurality of first cylinder bores each communicating with a respective one of the crankcase-defining cavities, and a second front cylinder portion spaced from the first front cylinder portion and including a generally planar front mounting surface mating with the second rear mounting surface on the base portion, the second front cylinder portion partially defining a plurality of second cylinder bores each communicating with a respective one of the crankcase-defining cavities.

The invention also provides a foam pattern assembly for use in forming an engine block in a lost foam casting process, the pattern assembly comprising a cylinder bore, an adjacent cavity, and a wall partially defining the cylinder bore and the cavity and having therein an aperture communicating between the cylinder bore and the cavity.

The invention also provides a foam pattern assembly for use in forming an engine block in a lost foam casting process, the pattern assembly comprising a base portion including a generally planar front surface having therein a plurality of crankcase-defining cavities, a plurality of first intake ports and a plurality of second intake ports, a first rear mounting surface spaced from the front surface, and a second rear mounting surface spaced from the front surface, the base portion partially defining a plurality of first transfer passages, a plurality of second transfer passages, a plurality of first air intake passages each communicating between a respective one of the first intake ports and a respective one of the crankcase-defining cavities, and a plurality of second air intake passages each communicating between a respective one of the second intake ports and a respective one of the crankcase-defining cavities, a first front cylinder portion including a generally planar front mounting surface mating with the first rear mounting surface on the base portion, and a generally planar rear mounting surface spaced from the front mounting surface on the first front cylinder portion, the first front cylinder portion partially defining the first transfer passages and the first air intake passages, and the first front cylinder portion partially defining a plurality of first cylinder bores each communicating with a respective one of the first transfer passages, a plurality of first exhaust passages each communicating with a respective one of the first cylinder bores, and a first water jacket located adjacent the first cylinder bores, a second front cylinder portion spaced from the first front cylinder portion and including a generally planar front mounting surface mating with the second rear mounting surface on the base portion, and a generally planar rear mounting surface spaced from the front mounting surface on the second front cylinder portion, the second front cylinder portion partially defining the second transfer passages and the second air intake passages, and the second front cylinder portion partially defining a plurality of second cylinder bores each communicating with a respective one of the second transfer passages, a plurality of second exhaust passages each communicating with a respective one of the second cylinder bores, and a second water jacket located adjacent the second cylinder bores, a first rear cylinder portion including a generally planar front mounting surface mating with the rear mounting surface on the first front cylinder portion, and inner and outer rear mounting surfaces spaced from the front mounting surface on the first rear cylinder portion, the first rear cylinder portion partially defining the first cylinder bores, the first exhaust passages, the first water jacket, a rear water jacket, a first upstream exhaust passageway communicating with the first exhaust passages, and a first downstream exhaust passageway, the first upstream exhaust passageway and the first downstream exhaust passageway intersecting the inner rear mounting surface on the first rear cylinder portion, a second rear cylinder portion including a generally planar front mounting surface mating with the rear mounting surface on the second front cylinder portion, and inner and outer rear mounting surfaces spaced from the front mounting surface on the second rear cylinder portion, the second rear cylinder portion partially defining the second cylinder bores, the second exhaust passages, the second water jacket, the rear water jacket, a second upstream exhaust passageway communicating with the second exhaust passages, and a second downstream exhaust passageway, the second upstream exhaust passageway and the second downstream exhaust passageway intersecting the inner rear mounting surface on the second rear cylinder portion, a first cover portion including a generally planar front mounting surface mating with the outer rear mounting surface on the first rear cylinder portion, the first cover portion partially defining the first cylinder bores and the first water jacket, a second cover portion including a generally planar front mounting surface mating with the outer rear mounting surface on the second rear cylinder portion, the second cover portion partially defining the second cylinder bores and the second water jacket, a front exhaust portion including a first front mounting surface mating with the inner rear mounting surface on the first rear cylinder portion, a second front mounting surface mating with the inner rear mounting surface on the second rear cylinder portion, and a rear mounting surface spaced from the front mounting surfaces on the front exhaust portion, the front exhaust portion partially defining the first and second upstream exhaust passageways, the rear water jacket, and the first and second downstream exhaust passageways, the rear water jacket, the first and second upstream exhaust passageways and the first and second downstream exhaust passageways intersecting the front and rear mounting surfaces on the front exhaust portion, an intermediate exhaust portion including a front mounting surface mating with the rear mounting surface on the front exhaust portion, and a rear mounting surface spaced from the front mounting surface on the intermediate exhaust portion, the intermediate exhaust portion partially defining the rear water jacket, a first intermediate exhaust passageway communicating between the first upstream exhaust passageway and the first downstream exhaust passageway, and a second intermediate exhaust passageway communicating between the second upstream exhaust passageway and the second downstream exhaust passageway, the first and second intermediate exhaust passageways intersecting the front and rear mounting surfaces on the intermediate exhaust portion, a rear exhaust portion including a front mounting surface mating with the rear mounting surface on the intermediate exhaust portion, the rear exhaust portion partially defining the rear water jacket, and the first and second intermediate exhaust passageways, the first and second intermediate exhaust passageways intersecting the front mounting surface on the rear exhaust portion, and a rear cover portion including a front mounting surface mating with the rear mounting surface on the front exhaust portion, the rear cover portion partially defining the rear water jacket.

The invention also provides a foam pattern assembly for use in forming an engine block in a lost foam casting process, the pattern assembly comprising a cylinder portion including a mounting surface and partially defining a cylinder bore and a water jacket intersecting the mounting surface, and a cover portion partially closing the water jacket and including a mounting surface mating with the mounting surface on the cylinder portion.

The invention also provides a foam pattern assembly for use in forming an engine block in a lost foam casting process, the pattern assembly comprising a first section at least partially defining a cylinder bore and including a mounting surface having therein an exhaust outlet port communicating with the cylinder bore, and an exhaust inlet port spaced from the exhaust outlet port, and a second section including a mounting surface mating with the first section mounting surface, the second section defining an exhaust passageway communicating between the exhaust outlet port and the exhaust inlet port.

The invention also provides a foam pattern assembly for use in forming an engine block in a lost foam casting process, the pattern assembly having therein a cylinder, and an exhaust passage communicating with the cylinder and including a first, undercut portion preventing removal of a forming die from the exhaust passage in one direction, and a second portion permitting removal of a forming die from the exhaust passage in the one direction, the pattern assembly comprising a first pattern piece having therein a passage which defines the second portion of the exhaust passage and which permits removal of a forming die from the first pattern piece passage in the one direction, and a second pattern piece mating with the first pattern piece and including a projection which extends into the first pattern piece passage and which defines the undercut portion of the exhaust passage.

The invention also provides a foam pattern assembly comprising a first piece having therein a recess permitting removal of a forming die from the first piece in one direction, and a second piece including a projection which extends into the recess and which has therein a passage communicating with the recess and including an undercut portion preventing removal of a forming die from the second piece in the one direction.

The invention also provides a foam pattern assembly for use in forming an engine block in a lost foam casting process, the pattern assembly comprising a first portion including a mounting surface having therein an exhaust outlet port, a second portion including a first mounting surface mating with the first portion mounting surface, and a second mounting surface, the second portion defining a passageway portion communicating with the exhaust outlet port, and a third portion including a mounting surface mating with the second mounting surface, the third portion defining a passageway communicating with the passageway of the second pattern portion.

The invention also provides a foam pattern assembly for use in forming an engine block in a lost foam casting process, the pattern assembly comprising a base section, a first cylinder section which is mounted on the base section and which partially defines a plurality of first cylinder bores, and a second cylinder section which is mounted on the base section, which is not directly connected to the first cylinder section and which partially defines a plurality of second cylinder bores.

The invention also provides a foam pattern assembly comprising a first piece having therein a recess, and a second piece including a projection which extends into the recess and which is spaced from the second piece.

The invention also provides a foam pattern assembly comprising a first piece including a first glue surface having therein a recess, and a second piece including a second glue surface having thereon a projection which extends into the recess and which is not glued to the first piece.

The invention also provides a foam pattern assembly for use in forming a V-type engine block in a lost foam casting process, the pattern assembly comprising a plurality of pattern portions each including at least one glue surface mating with a glue surface of another of the pattern portions, the pattern assembly comprising no non-parallel intersecting glue surfaces.

The invention also provides a method for casting an engine block in a lost foam casting process, the method comprising the steps of providing a foam pattern assembly including a cylinder bore, a cavity and a wall partially defining the cylinder bore, partially defining the cavity and having therein an aperture communicating between the cylinder bore and the cavity, utilizing the pattern assembly in a lost foam casting process so that sand flows through the aperture and so as to form an engine block including a cylinder bore, a wall and an aperture respectively corresponding to the cylinder bore, the wall and the aperture of the pattern assembly, providing a cylinder liner, and inserting the cylinder liner into the cylinder bore of the engine block so that the cylinder liner closes the aperture of the engine block and defines a cylinder.

The invention also provides a method for casting an engine block in a lost foam casting process, the method comprising the steps of providing a foam pattern assembly including first and second cylinder bores, a transfer passage communicating with the second cylinder bore, and a wall partially defining the first cylinder bore and partially defining the transfer passage, utilizing the pattern assembly in a lost foam casting process so as to form an engine block including a cylinder bore and a wall respectively corresponding to the first cylinder bore and the wall of the pattern assembly, grinding out the cylinder bore of the engine block so as to form an aperture in the wall of the engine block, providing a cylinder liner, and inserting the cylinder liner into the cylinder bore of the engine block so that the cylinder liner closes the aperture, defines a cylinder and partially defines the transfer passage of the engine block.

The invention also provides an internal combustion engine comprising an engine block including first and second cylinder bores and a transfer passage communicating with the second cylinder bore, and a cylinder liner which is housed in the first cylinder bore and which partially defines the transfer passage.

Other features and advantages of the invention will become apparent to those skilled in the art upon review of the following detailed description, claims and drawings.

DESCRIPTION OF THE DRAWINGS

FIG. 10 is a rear elevational view of the assembly with the front, intermediate and rear exhaust portions and the rear cover portion removed.

FIG. 11 is a view taken along line 11—11 in FIG. 4 and turned 90° counterclockwise.

FIG. 23 is a view taken along line 23—23 in FIG. 2.

FIG. 24 is a view taken along line 23—24 in FIG. 2.

FIG. 29 is a partial sectional view taken along line 29—29 in FIG. 1.

Figure 1:
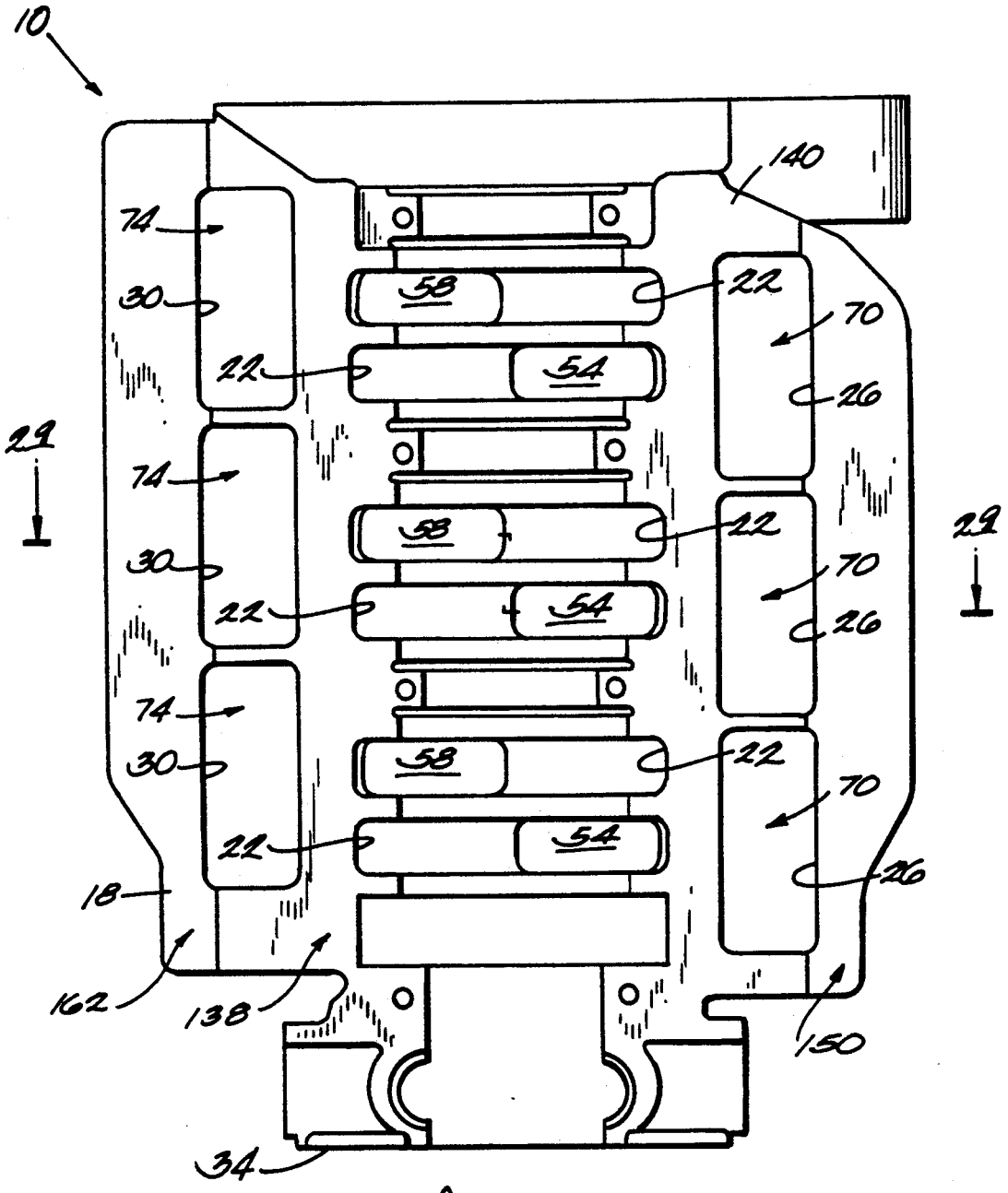
FIG. 1 is a front elevational view of a foam pattern assembly which embodies the invention and which comprises a crankcase portion, right and left front cylinder portions, right and left rear cylinder portions, right and left cover portions, front, intermediate and rear exhaust portions, and a rear cover portion.
Figure 3:
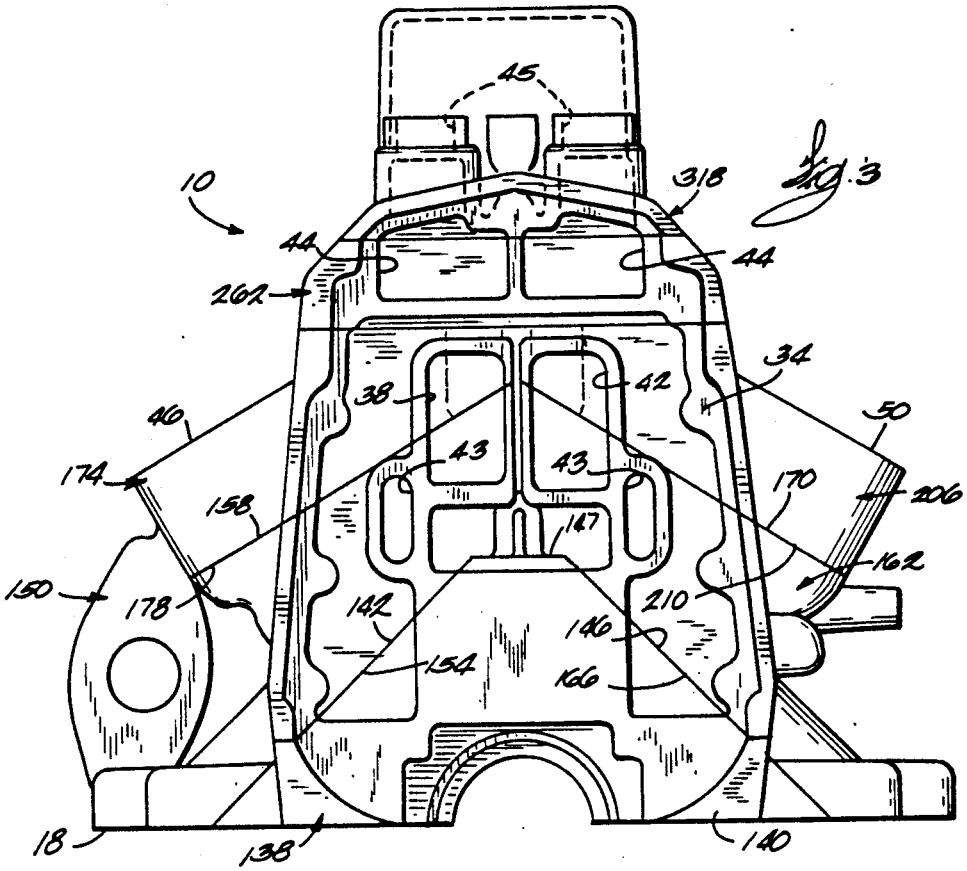
FIG. 3 is a bottom plan view of the assembly.
Figure 2:
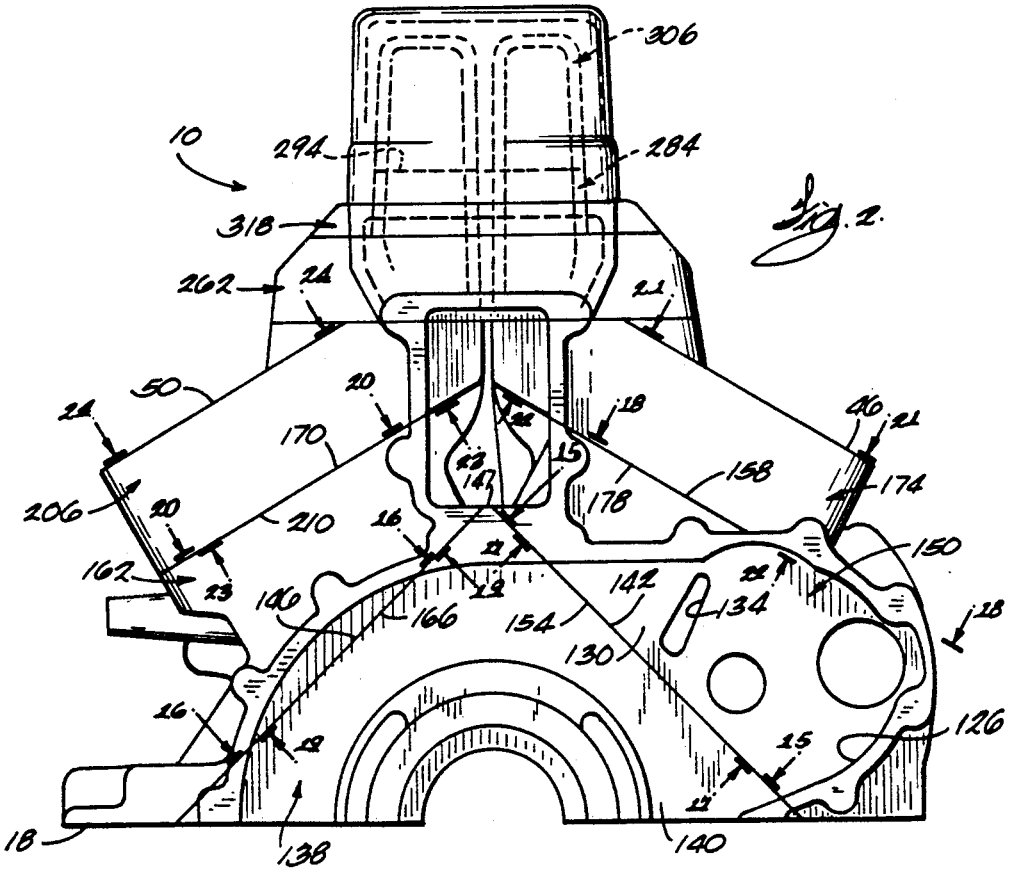
FIG. 2 is a top plan view of the assembly.
Figure 4:
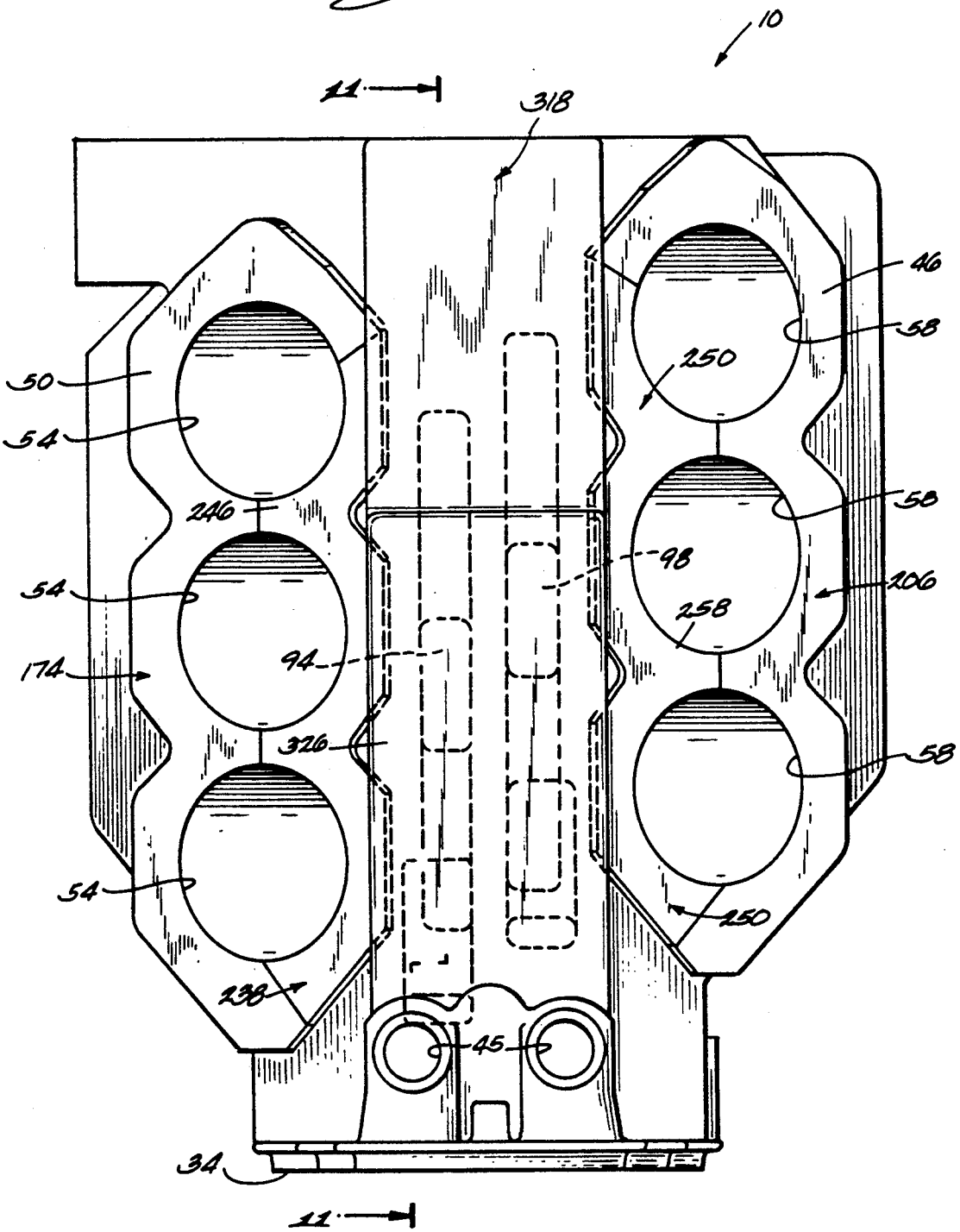
FIG. 4 is a rear elevational view of the assembly.
Figure 5:
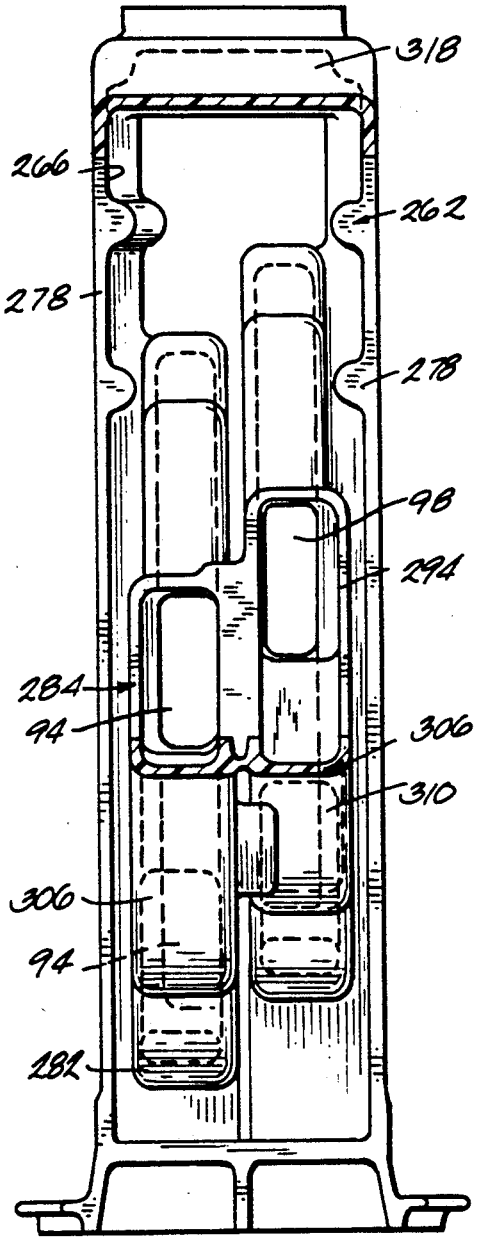
FIG. 5 is a partial rear elevational view showing the front, intermediate and rear exhaust portions and the rear cover portion with parts broken away.
Figure 6:
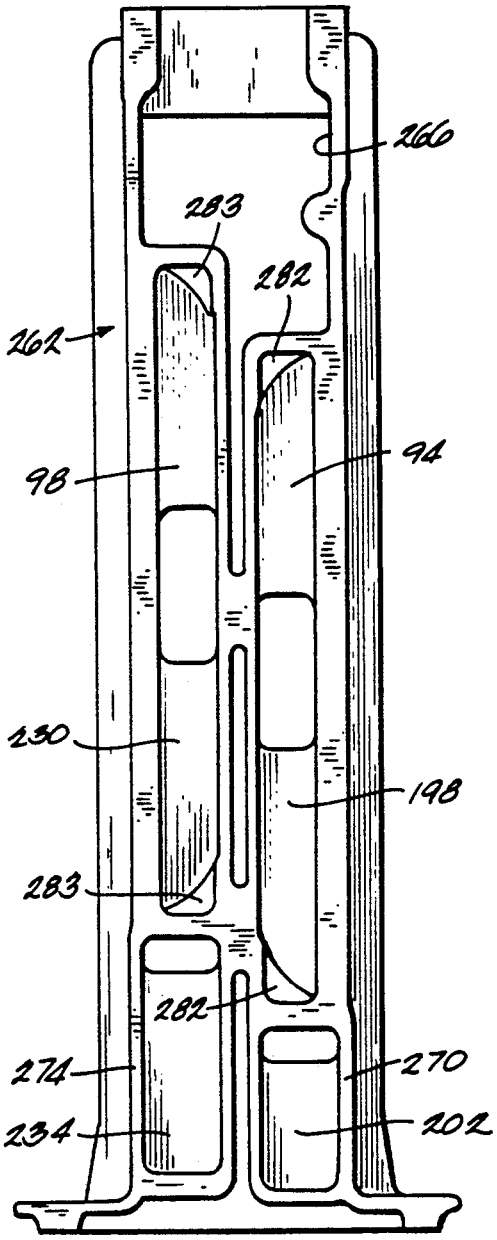
FIG. 6 is a front elevational view of the forward exhaust portion.
Figure 7:
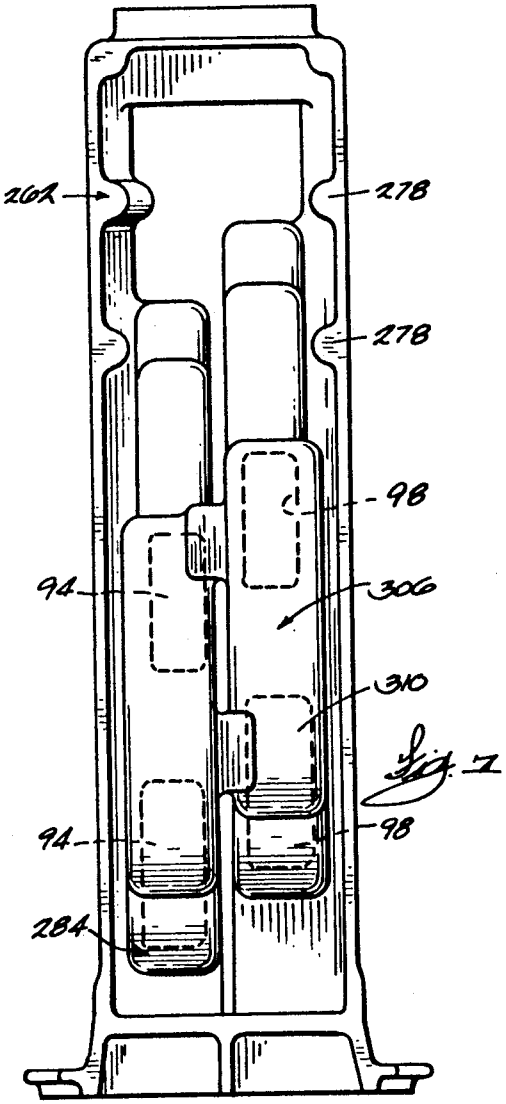
FIG. 7 is a partial rear elevational view showing the front, intermediate and rear exhaust portions with the rear cover portion removed.
Figure 8:
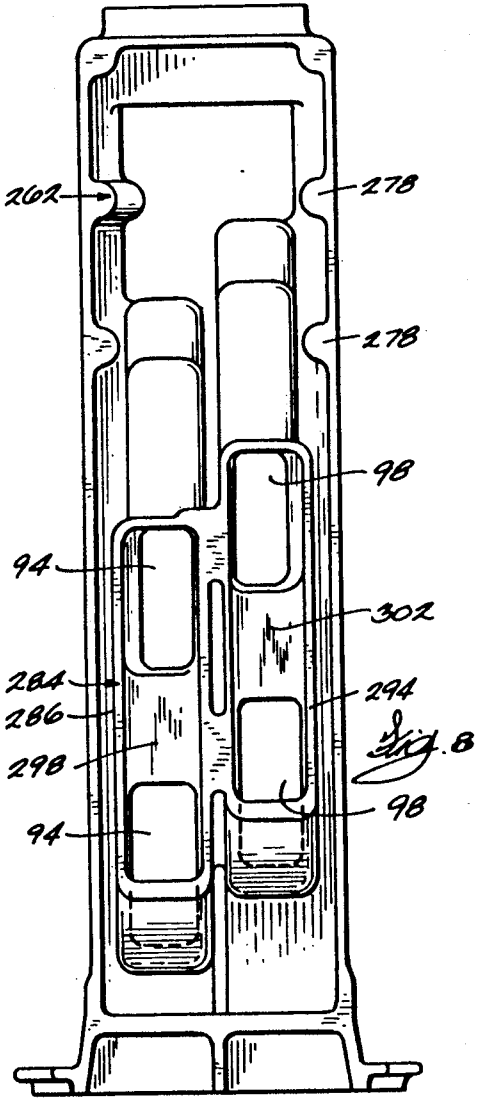
FIG. 8 is a view similar to FIG. 7 with the rear exhaust portion removed.
Figure 9:
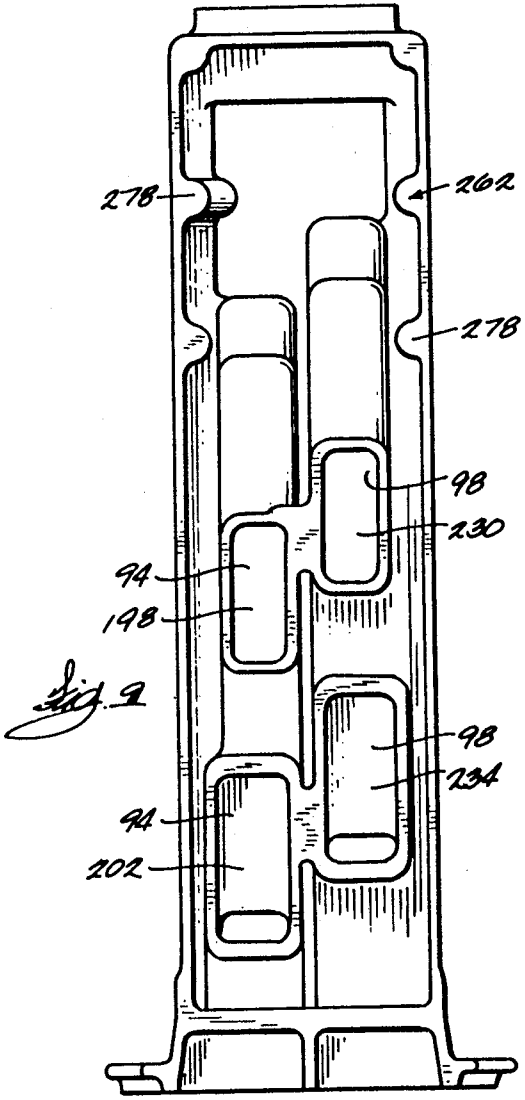
FIG. 9 is a view similar to FIG. 8 with the intermediate exhaust portion removed.
Figure 12:
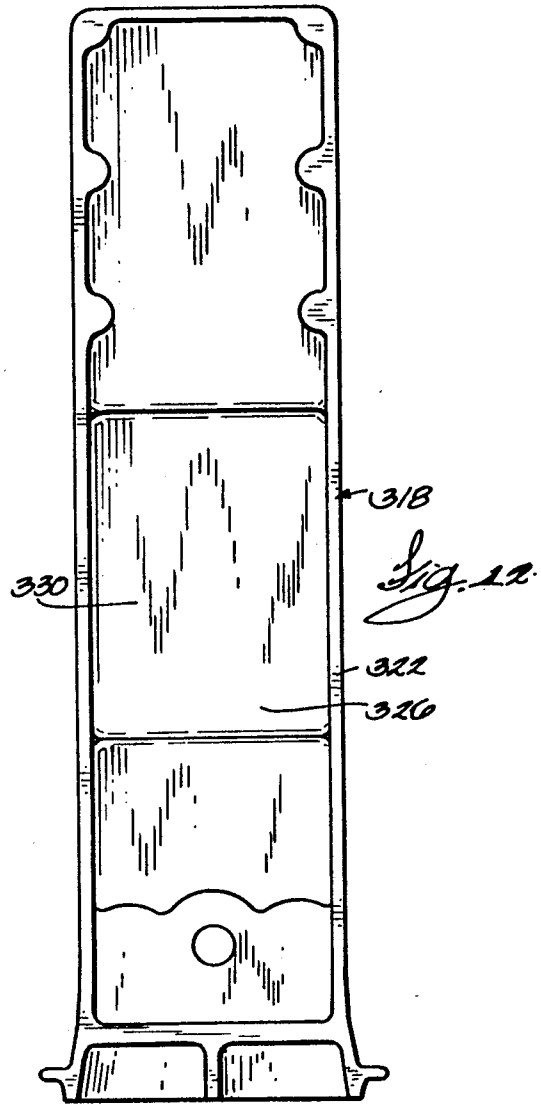
FIG. 12 is a front elevational view of the rear cover portion.
Figure 13:
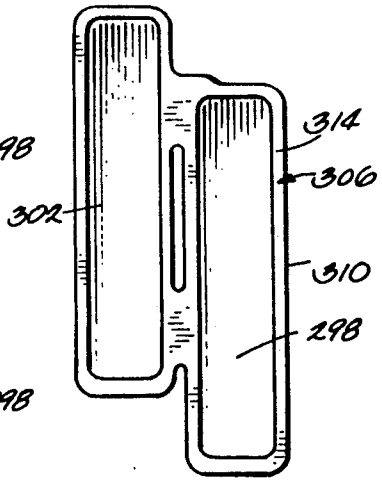
FIG. 13 is a front elevational view of the rear exhaust portion.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A foam pattern assembly 10 which embodies the invention and which is used in forming an engine block 14 (FIG. 32) in a lost foam casting process is illustrated in FIGS. 1-31. The engine block 14 is preferably a V-type block. While other engine block arrangements could be employed, in the preferred embodiment, the angle of the V is 60°.

The foam pattern assembly 10 comprises a generally planar front surface 18 having therein a plurality of crankcase-defining cavities 22, a plurality of first or right intake ports 26 and a plurality of second or left intake ports 30. While the assembly 10 can comprise any suitable number of crankcase-defining cavities 22 and intake ports 26 and 30, in the preferred embodiment, the surface 18 has therein six crankcase-defining cavities 22, three right intake ports 26 and three left intake ports 30. The pattern assembly 10 also comprises (see FIGS. 1 and 3) a bottom surface 34 having therein right and left exhaust outlets 38 and 42, respectively, a pair of water jacket outlet ports 43 and a pair of idle exhaust inlet ports 44. The assembly 10 also comprises idle exhaust outlet ports 45 communicating with the inlet ports 44. The function of the ports 44 and 45 is explained in application Ser. No. 316,417 filed concurrently herewith now U.S. Pat. No. 4,966,567. The assembly 10 also comprises right and left cylinder head faces 46 and 50, respectively, which correspond to faces on the resulting engine block 14 to which cylinder heads (not shown) are attached.

The pattern assembly 10 also comprises (see FIG. 4) a bank of first or right cylinder bores 54 extending from the right cylinder head face 46, and a bank of second or left cylinder bores 58 extending from the left cylinder head face 50. While the assembly 10 could have any suitable number of left and right cylinder bores, in the preferred embodiment, the assembly 10 has three right cylinder bores 54 and three left cylinder bores 58. More particularly, the assembly 10 has a lowermost, an intermediate, and an uppermost right cylinder bore 54, and a lowermost, an intermediate, and an uppermost left cylinder bore 58.

The pattern assembly 10 also comprises a plurality of first or right transfer passages 62 (FIGS. 15 and 17) each communicating between a respective crankcase-defining cavity 22 and a respective right cylinder bore 54, and a plurality of second or left transfer passages 66 (FIGS. 16 and 19) each communicating between a respective crankcase-defining cavity 22 and a respective left cylinder bore 58. The assembly 10 also comprises a plurality of first or right air intake passages 70 (FIGS. 2, 15 and 17) each communicating between a respective right intake port 26 and a respective crankcase-defining cavity 22, and a plurality of second or left air intake passages 74 (FIGS. 2, 16 and 19) each communicating between a respective left intake port 30 and a respective crankcase-defining cavity 22. In the preferred embodiment, the assembly 10 comprises nine right transfer passages 62, with three right transfer passages 62 communicating with each right cylinder bore 54, nine left transfer passages 66, with three left transfer passages 66 communicating with each left cylinder bore 58, three right air intake passages 70 and three left air intake passages 74. Because each air intake passage 70 or 74 communicates with a respective crankcase-defining cavity 22 and each crankcase-defining cavity 22 communicates with three associated transfer passages 62 or 66, each air intake passage 70 or 74 also communicates with three associated transfer passages 62 or 66. Thus, each air intake passage 70 or 74 communicates with one of (a) a respective crankcase-defining cavity 22, (b) a respective transfer passage 62 or 66, and (c) both a respective crankcase-defining cavity 22 and a respective transfer passage 62 or 66.

The pattern assembly 10 also comprises three first or right exhaust passages 78 (FIGS. 18 and 22) each communicating with a respective one of the right cylinder bores 54, three second or left exhaust passages 82 (FIGS. 20 and 23) each communicating with a respective one of the left cylinder bores 58, a right water jacket 86 (FIGS. 18, 21 and 22) located adjacent the right cylinder bores 54, and a left water jacket 90 (FIGS. 20, 23 and 24) located adjacent the left cylinder bores 58.

The assembly 10 also comprises (see FIGS. 4–6) a right exhaust passageway 94 communicating between the right exhaust passages 78 and the right exhaust outlet 38, and a left exhaust passageway 98 communicating between the left exhaust passages 82 and the left exhaust outlet 42. The assembly 10 also comprises (see FIG. 11) a rear water jacket 102 located adjacent the exhaust passageways 94 and 98.

The assembly 10 also comprises (see FIGS. 17, 19, 27 and 28) a wall 106 partially defining the lowermost right cylinder bore 54 and partially defining a transfer passage 62 communicating with the intermediate right cylinder bore 54, a wall 110 partially defining the intermediate right cylinder bore 54 and partially defining a transfer passage 62 communicating with the uppermost right cylinder bore 54, a wall 114 partially defining the lowermost left cylinder bore 58 and partially defining a transfer passage 66 communicating with the intermediate left cylinder bore 58, and a wall 118 partially defining the intermediate left cylinder bore 58 and partially defining a transfer passage 66 communicating with the uppermost left cylinder bore 58.

The walls 106, 110, 114 and 118 are substantially identical and each is extremely thin and tapers down to an aperture 122 communicating between the associated cylinder bore 54 or 58 and the associated transfer passage 62 or 66. In alternative embodiments, the walls 106, 110, 114 and 118 can be extremely thin but not have therein apertures. The reason for the thin walls is explained hereinafter.

The assembly 10 also comprises (see FIGS. 17, 25 and 26) a cavity or recess 126 and a wall 130 partially defining the uppermost right cylinder bore 54 and the cavity 126 and having therein an aperture 134 affording sand flow through the wall 130 when the foam pattern assembly 10 is used in a lost foam casting process. This is explained in greater detail hereinafter.

It should be understood that both the apertures 122 and the aperture 134 constitute apertures communicating between a cylinder bore and an adjacent cavity.

The pattern assembly 10 comprises eleven pieces or portions. The pieces are glued together or otherwise suitably connected to form the assembly 10.

More particularly, the pattern assembly 10 comprises (see FIGS. 1–3) a base or crankcase portion 138 including a portion of the front surface 18, which has therein the crankcase-defining cavities 22 and the right and left intake ports 26 and 30. The base portion 138 also includes an outer surface 140, and a first or right rear mounting or glue surface 142 (FIGS. 2 and 3) spaced from the front surface 18 and disposed at an angle of approximately 45° relative to the front surface 18. It should be understood that the right rear mounting surface 142 could be disposed at other angles relative to the front surface 18. The base portion 138 also includes a second or left rear mounting or glue surface 146 spaced from the front surface 18 and disposed at an angle of approximately 45° relative to the front surface 18 and at an angle of approximately 90° relative to the first or right rear mounting surface 142, i.e., transversely to the surface 142. The left rear mounting surface 146 could also be disposed at other angles relative to the front surface 18 but is preferably disposed at the same angle relative to the front surface 18 as is the right rear mounting surface 142. The surfaces 142 and 146 do not intersect. Instead, a third, flat surface 147 (FIGS. 2 and 3) extends between the ends of the surfaces 142 and 146.

Figure 16:
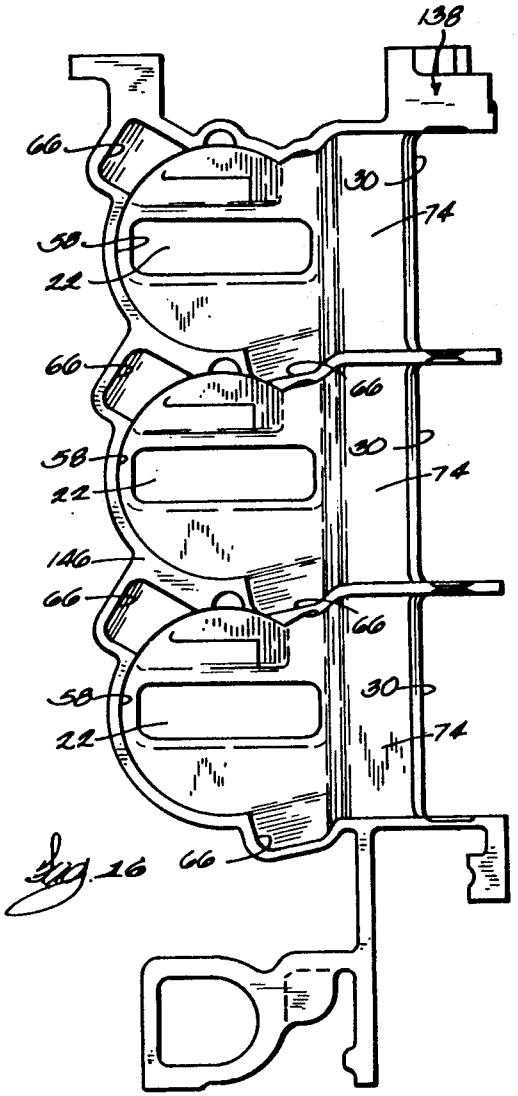
FIG. 16 is a view taken along line 16—16 in FIG. 2.
Figure 15:
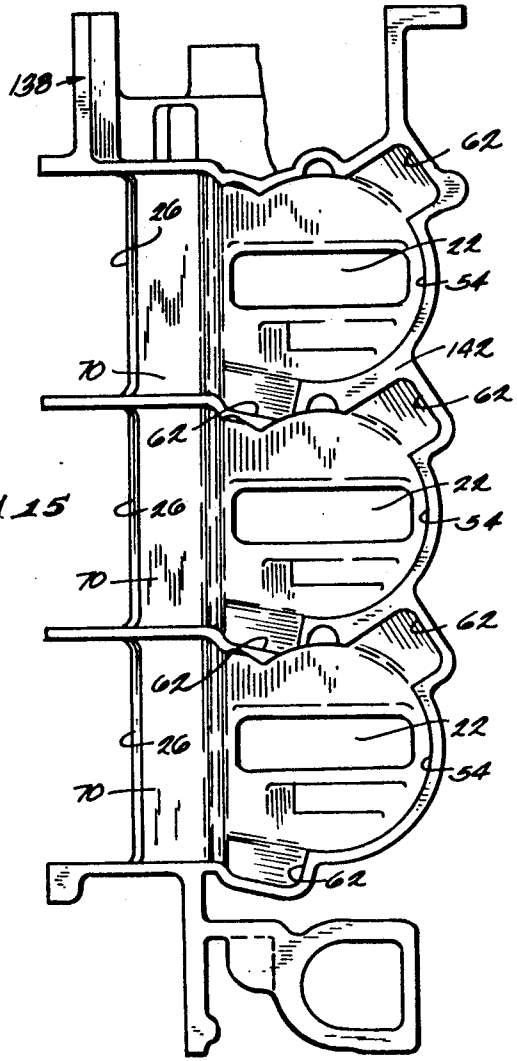
FIG. 15 is a view taken along line 15—15 in FIG. 2.
Figure 17:
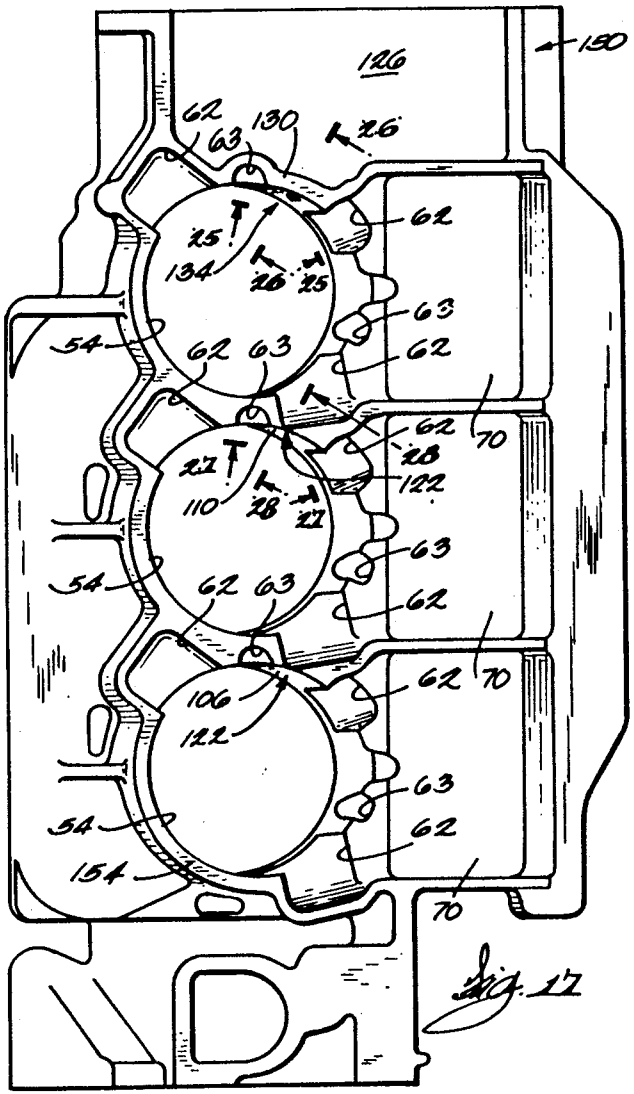
FIG. 17 is a view taken along line 17—17 in FIG. 2.
Figure 18:
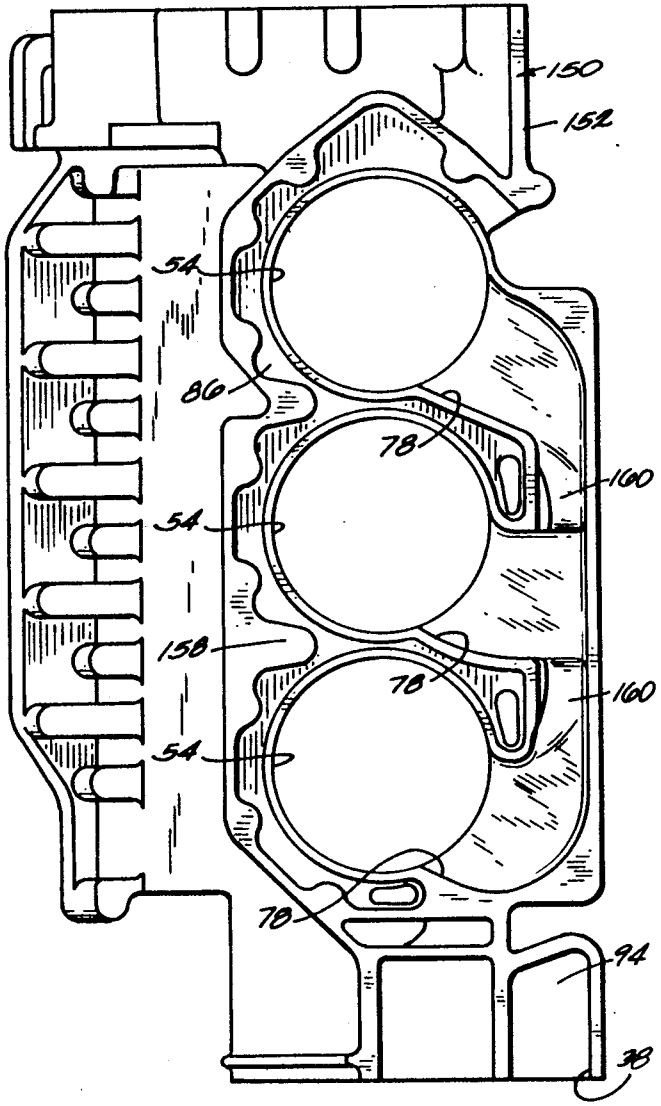
FIG. 18 is a view taken along line 18—18 in FIG. 2.
Figure 19:
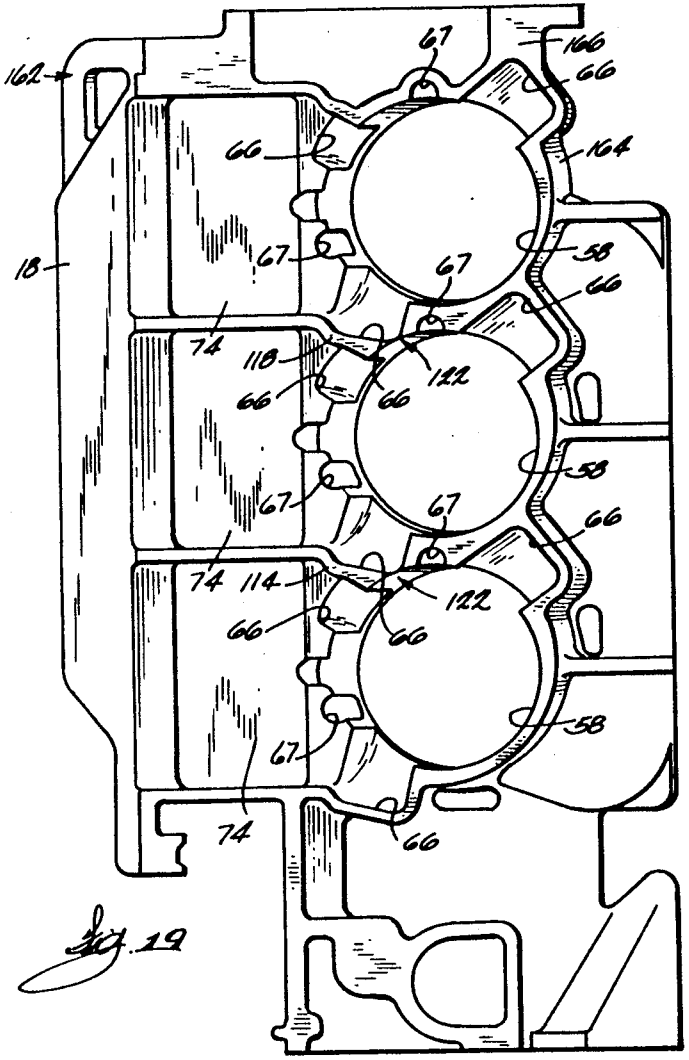
FIG. 19 is a view taken along line 19—19 in FIG. 2.
Figure 20:
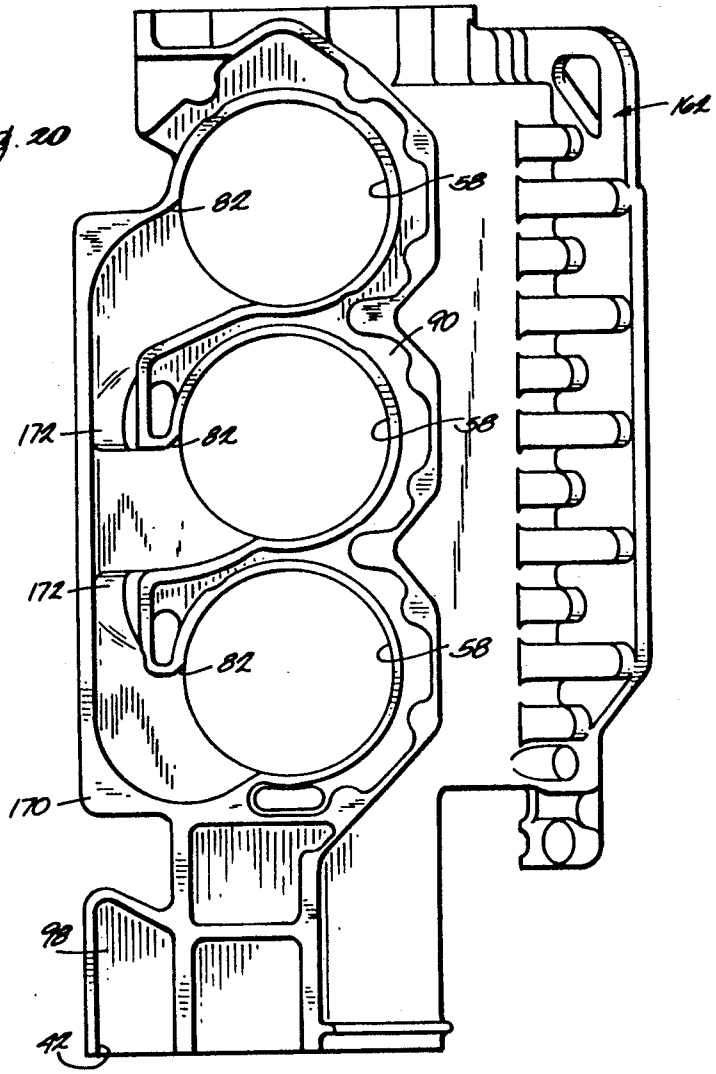
FIG. 20 is a view taken along line 20—20 in FIG. 2.
Figure 21:
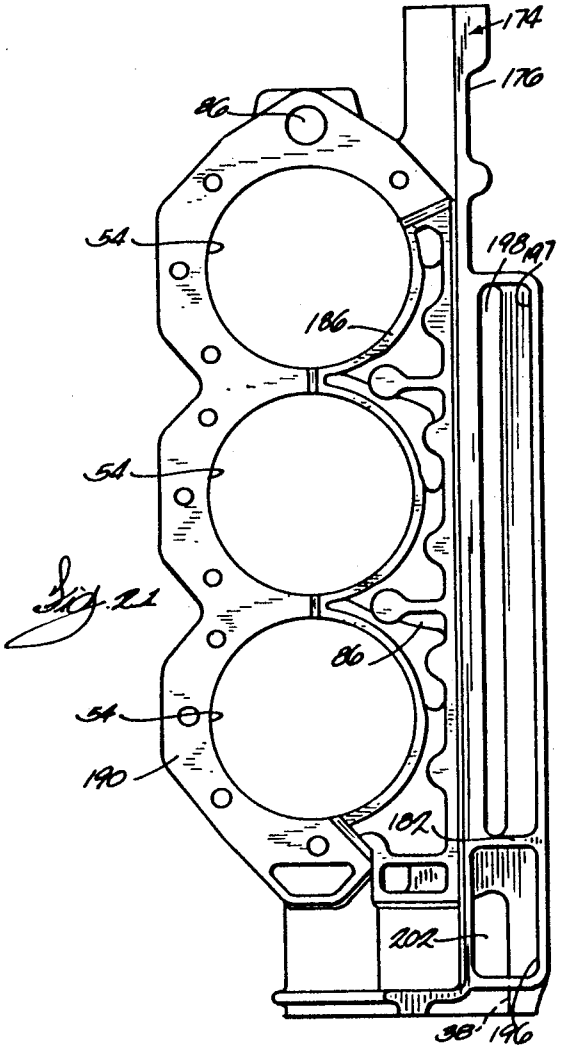
FIG. 21 is a view taken along line 21—21 in FIG. 2.
Figure 22:
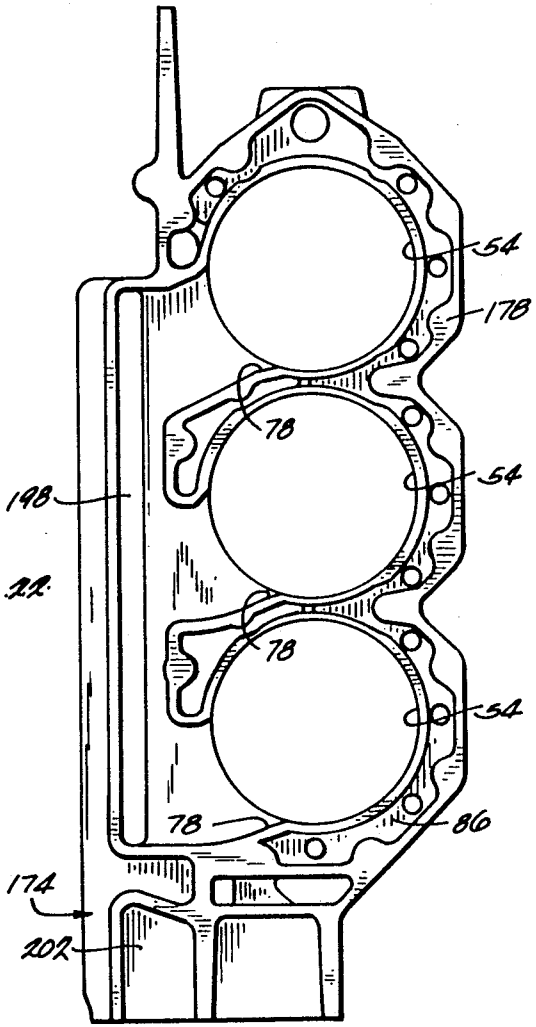
FIG. 22 is a view taken along line 22—22 in FIG. 2.
Figure 12:
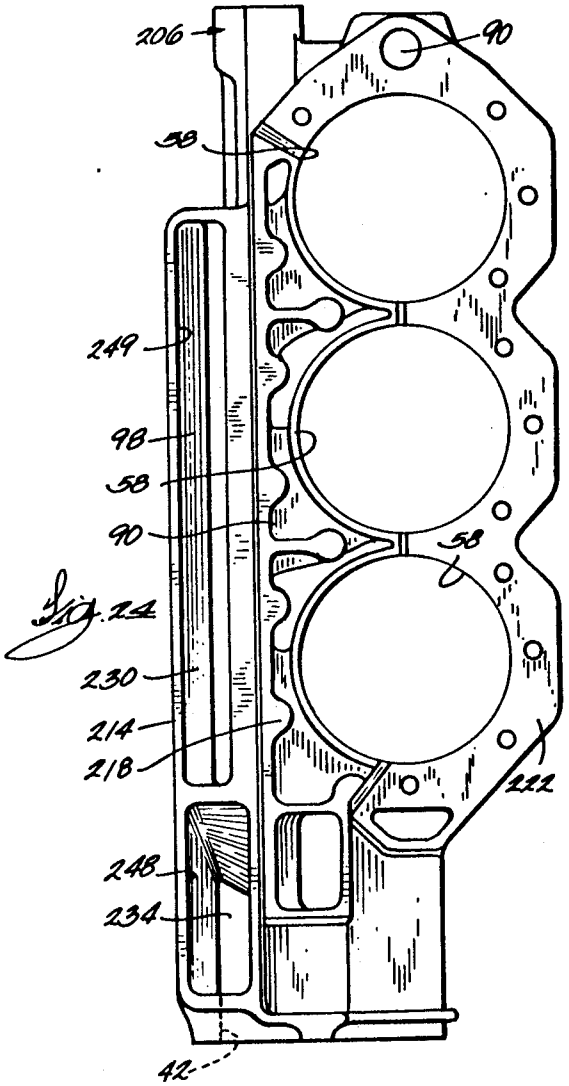
Figure 13:
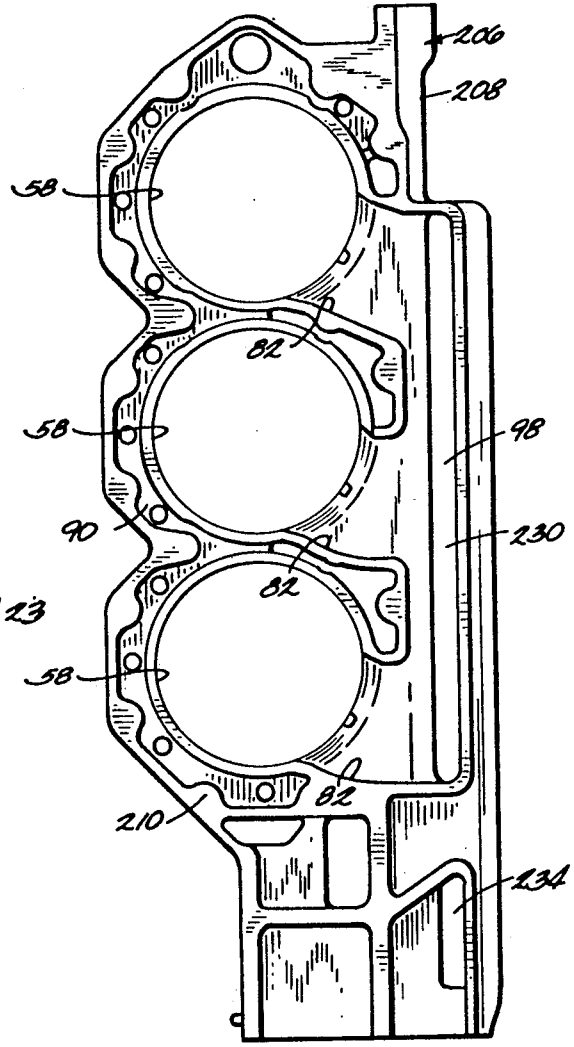

The base portion 138 partially defines the right and left cylinder bores 54 and 58, the right and left transfer passages 62 and 66, and the right and left air intake passages 70 and 74. The right cylinder bores 54 and the right transfer passages 62 intersect the right rear mounting surface 142, as shown in FIG. 15. The left cylinder bores 58 and the left transfer passages 66 intersect the left rear mounting surface 146, as shown in FIG. 16.

The foam pattern assembly 10 also comprises (see FIGS. 2, 3, 17 and 18) a first or right front cylinder portion 150 including a portion of the front surface 18, an outer surface 152, a generally planar front mounting or glue surface 154 mating with the right rear mounting surface 142 on the base portion 138, and a generally planar rear mounting or glue surface 158. The rear mounting surface 158 is spaced from the front mounting surface 154 and is preferably disposed at an angle of approximately 30° relative to the front mounting surface 18 on the base portion 138 and at an angle of approximately 15° relative to the right rear mounting surface 142 on the base portion 138. The rear glue surface 15B has thereon a pair of projections 160 (FIGS. 11 and 18) which are discussed hereinafter.

The right front cylinder portion 150 partially defines the right cylinder bores 54 and includes the portion of the wall 106 that has therein the associated aperture 122, the portion of the wall 110 that has therein the associated aperture 122 and the portion of the wall 130 that has therein the aperture 134. The right cylinder bores 54 intersect both the front and rear mounting surfaces 154 and 158 on the right front cylinder portion 150 and preferably extend generally perpendicular to the rear mounting surface 158. The right front cylinder portion 150 also partially defines the right transfer passages 62, the right air intake passages 70, the right exhaust passages 78, and the right water jacket 86. The right transfer passages 62 intersect the front mounting surface 154, and the right exhaust passages 78 and the right water jacket 86 intersect the rear mounting surface 158. The right front cylinder portion 150 also partially defines the right exhaust outlet 38 and a portion of the right exhaust passageway 94 communicating with the exhaust outlet 38.

The foam pattern assembly 10 also comprises (see FIGS. 2, 3, 19 and 20) a second or left front cylinder portion 162 spaced from (i.e., not directly connected to) the right front cylinder portion 150 and including a portion of the front surface 18, an outer surface 164, a generally planar front mounting or glue surface 166 mating with the left rear mounting surface 146 on the base portion 138, and a generally planar rear mounting or glue surface 170. The rear mounting surface 170 is spaced from the front mounting surface 166 and is preferably disposed at an angle of approximately 30° relative to the front surface 18 on the base portion 138 and at an angle of approximately 15° relative to the left rear mounting surface 146 on the base portion 138. The rear glue surface 170 has thereon a pair of projections 172 (FIG. 20), which are discussed hereinafter.

The left front cylinder portion 162 partially defines the left cylinder bores 58 and includes the portion of the wall 114 that has therein the associated aperture 122 and the portion of the wall 118 that has therein the associated aperture 122. The left cylinder bores 58 intersect both the front and rear mounting surfaces 166 and 170 on the left front cylinder portion 162 and preferably extend generally perpendicular to the rear mounting surface 170. The left front cylinder portion 162 also partially defines the left transfer passages 66, the left air intake passages 74, the left exhaust passages 82, and the left water jacket 90. The left transfer passages 66 intersect the front mounting surface 166, and the left exhaust passages 82 and the left water jacket 90 intersect the rear mounting surface 170. The left front cylinder portion 162 also partially defines the left exhaust outlet 42 and a portion of the left exhaust passageway 98 communicating with the exhaust outlet 42.

The foam pattern assembly 10 also comprises (see FIGS. 2, 3, 21 and 22) a first or right rear cylinder portion 174 spaced from the cylinder portion 162 and including an outer surface 176, a generally planar front mounting or glue surface 178 mating with the rear mounting surface 158 on the right front cylinder portion 150, and inner and outer rear mounting or glue surfaces 182 and 186 spaced from the front mounting surface 178 on the right rear cylinder portion 174, and an outer rear surface 190. The rear surfaces 186 and 190 preferably extend generally parallel to the front mounting surface 178 on the right rear cylinder portion 174 and the surface 186 is disposed forwardly of, or below, the surface 190. The inner rear mounting surface 182 preferably extends at an angle of approximately 30° relative to the outer rear mounting surface 186 and is parallel to the front surface 18 on the base portion 138. The inner rear mounting surface 182 has therein an exhaust inlet port 196 and an exhaust outlet port 197 spaced from the inlet port 196.

The right rear cylinder portion 174 partially defines the right cylinder bores 54, the right exhaust passages 78 and the right water jacket 86. The right rear cylinder portion 174 also partially defines the rear water jacket 102, a first or right upstream exhaust passageway portion 198 (FIG. 21) communicating with the right exhaust passages 78, and a first or right downstream exhaust passageway portion 202. The right cylinder bores 54 and the right water jacket 86 intersect the outer rear mounting surface 186 and the rear surface 190. The right cylinder bores 54 and the right water jacket 86 intersect the front mounting surface 178 on the right rear cylinder portion 174. The right upstream exhaust passageway portion 198 and the right downstream exhaust passageway portion 202 intersect the front mounting surface 178 and the inner rear mounting surface 182 on the right rear cylinder portion 174. The right rear cylinder portion 174 also partially defines the right exhaust outlet 38, and the portion of the right downstream exhaust passageway portion 202 in the cylinder portion 174 communicates between the exhaust inlet port 196 and the right exhaust outlet 38. The portion of the right upstream exhaust passageway portion 198 in the cylinder portion 174 communicates with the exhaust outlet port 197.

The foam pattern assembly 10 also comprises (see FIGS. 2, 3, 23 and 24) a second or left rear cylinder portion 206 spaced from the cylinder portions 150 and 174 and including an outer surface 208, a generally planar front mounting or glue surface 210 mating with the rear mounting surface 170 on the left front cylinder portion 162, inner and outer rear mounting or glue surfaces 214 and 218 spaced from the front mounting surface 210 on the left rear cylinder portion 206, and an outer rear surface 222. The rear surfaces 218 and 222 preferably extend generally parallel to the front mounting surface 210 on the left rear cylinder portion 206 and the surface 218 is disposed forwardly of, or below, the surface 222. The inner rear mounting surface 214 preferably extends at an angle of approximately 30° relative to the outer rear mounting surface 218 and is parallel to the front surface 18 on the base portion 138. The inner rear mounting surface 214 has therein an exhaust inlet port 248 and an exhaust outlet port 249 spaced from the inlet port 248.

The left rear cylinder portion 206 partially defines the left cylinder bores 58, the left exhaust passages 82 and the left water jacket 90. The left rear cylinder portion 206 also partially defines the rear water jacket 102, a second or left upstream exhaust passageway portion 230 communicating with the left exhaust passages 82, and a second or left downstream exhaust passageway portion 234. The left cylinder bores 58 and the left water jacket 90 intersect the outer rear mounting surface 218 and the rear surface 222. The left cylinder bores 58 and the left water jacket 90 intersect the front mounting surface 210 on the left rear cylinder portion 206. The left upstream exhaust passageway portion 230 and the left downstream exhaust passageway portion 234 intersect the front mounting surface 210 and the inner rear mounting surface 214 on the left rear cylinder portion 206. The left rear cylinder portion 206 also partially defines the left exhaust outlet 42. The portion of the left downstream exhaust passageway portion 234 in the cylinder portion 206 communicates between the exhaust inlet port 248 and the exhaust outlet 42. The portion of the left upstream exhaust passageway portion 230 in the cylinder portion 206 communicates with the exhaust outlet port 249.

The foam pattern assembly 10 also comprises (see FIGS. 4, 10 and 29) a first or right cover portion 238 including a generally planar front mounting or glue surface 242 mating with the surface 186 on the right rear cylinder portion 174, and a generally planar rear surface 246 which is generally coplanar with the surface 190 on the right rear cylinder portion 174. The rear surface 246 of the cover portion 238 and the surface 190 of the cylinder portion 174 combine to form the right cylinder head face 46. The right cover portion 238 partially defines the right cylinder bores 54 and the right water jacket 86. More particularly, the right cover portion 238 closes the right water jacket 86.

Use of the right cover portion 238 to close the right water jacket 86 permits a portion of the right water jacket 86 in the right rear cylinder portion 174 to be formed with a forming die that is withdrawn from the rear mounting surface 186 of the right rear cylinder portion 174. This is desirable because the portions of the exhaust passages 78 in the right rear cylinder portion 174 prevent the formation of the water jacket 86 entirely by a forming die that is removed from the front mounting surface 178 of the right rear cylinder portion 174. The alternative to using a separate cover portion is to split the cylinder portion 174 into two pieces. This alternative, however, is substantially more expensive.

The foam pattern assembly 10 also comprises (see FIGS. 4, 10 and 29) a second or left cover portion 250 including a generally planar front mounting or glue surface 254 mating with the mounting surface 218 on the left rear cylinder portion 206, and a generally planar rear surface 258 which is generally coplanar with the surface 222 on the left outer rear cylinder portion 206. The rear surface 258 of the cover portion 250 and the surface 222 of the cylinder portion 206 combine to form the left cylinder head face 50. The left cover portion 250 partially defines the left cylinder bores 58 and the left water jacket 90. More particularly, the left cover portion 250 closes the left water jacket 90.

Use of the left cover portion 258 to close the left water jacket 90 permits a portion of the left water jacket 90 in the left rear cylinder portion 206 to be formed with a forming die that is withdrawn from the rear mounting surface 218 of the left rear cylinder portion 206.

The foam pattern assembly 10 also comprises (see FIGS. 5, 6, 9, 11 and 29) a front exhaust portion 262 including an inner surface 266, a first or right front mounting or glue surface 270 mating with the inner rear mounting surface 182 on the right rear cylinder portion 174, a second or left front mounting or glue surface 274 mating with the inner rear mounting surface 214 on the left rear cylinder portion 206, and a rear mounting or glue surface 278 spaced from the front mounting surfaces 270 and 274. The front exhaust portion 262 partially defines the right and left upstream exhaust passageway portions 198 and 230, the rear water jacket 102, and the right and left downstream exhaust passageway portions 202 and 234. The right upstream exhaust passageway portion 198 and the right downstream exhaust passageway portion 202 intersect the front and rear mounting surfaces 270 and 278 on the front exhaust portion 262, and the left upstream exhaust passageway portion 230 and the left downstream exhaust passageway portion 234 intersect the front and rear mounting surfaces 274 and 278 on the front exhaust portion 262.

The portion of the right upstream exhaust passageway portion 198 in the front exhaust portion 262 communicates with the exhaust outlet port 197 in the right rear cylinder portion 174, and the portion of the right downstream exhaust passageway portion 202 in the front exhaust portion 262 communicates with the exhaust inlet port 196 in the cylinder portion 174. The portion of the left upstream exhaust passageway portion 230 in the front exhaust portion 262 communicates with the exhaust outlet port 249 in the left rear cylinder portion 206, and the portion of the left downstream exhaust passageway portion 234 in the front exhaust portion 262 communicates with the exhaust inlet port 248 in the cylinder portion 206.

As shown in FIG. 11, the right upstream exhaust passageway portion 198 includes a first, undercut portion 279 preventing rearward (upward in FIG. 11) removal of a forming die from the exhaust passageway portion 198, and a second, straight portion 280 permitting rearward removal of a forming die from the exhaust passageway portion 198. The right rear cylinder portion 174 has therein a passage 281 which defines the straight portion 280 of the exhaust passageway portion 198 and which permits rearward removal of a forming die from the passage 281 in the right rear cylinder portion 174.

In order to permit the undercut portion 279 of the exhaust passageway portion 198 to be located "in" the right rear cylinder portion 174 (i.e., forwardly of the rearward surface 182 of the cylinder portion 174) while permitting the use of a forming die which is removed rearwardly from the right rear cylinder portion 174 to form the passage 281, the front exhaust portion 262 includes a pair of projections 282 (FIGS. 6 and 11) which extend into the passage 281 in the right rear cylinder portion 174 and which define the undercut portion 279 of the exhaust passageway portion 198. In the preferred embodiment, the projections 282 are not glued to the cylinder portion 174. Instead, the projections 282 are spaced approximately 1/10" from the inner wall of the passage 281. This facilitates drying of any coating that flows between the projections 282 and the cylinder portion 174.

It should be noted that the portion of the passage 281 intersecting the surface 182 of the right rear cylinder portion 174 constitutes a recess in the right rear cylinder portion 174, and the projections 282 constitute a projection extending into the recess and having therein the undercut portion 279 of the passageway portion 198. Similarly, the portion of the passage 281 intersecting the surface 178 constitutes a recess in the right rear cylinder portion 174, and the projections 160 extend into the recess, are spaced from the cylinder portion 174 and are not glued to the cylinder portion 174.

The left upstream exhaust passageway portion 230 is substantially identical to the right upstream exhaust passageway portion 198, and the front exhaust portion 262 also includes projections 283 which extend into the left rear cylinder portion 206 and which define an undercut portion of the left upstream exhaust passageway portion 230. Also, the projections 172 on the cylinder portion 162 extend into the cylinder portion 206.

The foam pattern assembly 10 also comprises (see FIGS. 8, 11, 14 and 29) an intermediate exhaust portion 284 including an outer surface 286, a front mounting or glue surface 290 mating with the rear mounting surface 278 on the front exhaust portion 262, and a rear mounting or glue surface 294 spaced from the front mounting surface 290 on the intermediate exhaust portion 284. The intermediate exhaust portion 284 partially defines the rear water jacket 102, a first or right intermediate exhaust passageway portion 298 communicating between the right upstream exhaust passageway portion 198 and the right downstream exhaust passageway portion 202, and a second or left intermediate exhaust passageway portion 302 communicating between the left upstream exhaust passageway portion 230 and the left downstream exhaust passageway portion 234. The left and right intermediate exhaust passageway portions 298 and 302 intersect the front and rear mounting surfaces 290 and 294 on the intermediate exhaust portion 284.

The foam pattern assembly 10 also comprises (see FIGS. 7, 11, 13 and 29) a rear exhaust portion 306 including an outer surface 310, and a front mounting or glue surface 314 mating with the rear mounting surface 294 on the intermediate exhaust portion 284. The rear exhaust portion 306 partially defines the rear water jacket 102 and the left and right intermediate exhaust passaqeway portions 298 and 302. The left and riqht intermediate exhaust passageway portions 298 and 302 intersect the front mounting surface 314 on the rear exhaust portion 306.

The foam pattern assembly 10 also comprises (see FIGS. 4, 11, 12 and 29) a rear cover portion 318 including a front mounting or glue surface 322 mating with the rear mounting surface 278 on the front exhaust portion 262. The rear cover portion 318 includes a dome portion 326 which covers the intermediate exhaust portion 284 and the rear exhaust portion 306, and the rear cover portion 318 partially defines the rear water jacket 102. More particularly, the rear cover portion 318 also includes an inner surface 330, and the rear water jacket 102 is located between the inner surfaces 266 and 330, respectively, of the front exhaust portion 262 and the cover portion 318 and the outer surfaces 140, 164, 152, 208, 176, 286 and 310, respectively, of the base portion 138, the left and right front cylinder portions 162 and 150, the left and right rear cylinder portions 206 and 174, the intermediate exhaust portion 284 and the rear exhaust portion 306.

The right front cylinder portion 150 and the right rear cylinder portion 174 form a first section of the pattern assembly 10, which first section at least partially defines the right cylinder bores 54 and includes the mounting surface 182 having therein the exhaust outlet port 197, which communicates with the cylinder bores 54, and the exhaust inlet port 196, which is spaced from the exhaust outlet port 197. The first section also includes the right exhaust outlet 38 and defines the portion of the right exhaust passageway 94 communicating between the exhaust inlet port 196 and the exhaust outlet 38. The front exhaust portion 262, the intermediate exhaust portion 284 and the rear exhaust portion 306 form a second section of the pattern assembly 10, which second section includes the mounting surface 270 mating with the mounting surface 182 and which second section defines an exhaust passageway (the right upstream exhaust passageway portion 198, the right intermediate exhaust passageway portion 298 and the right downstream exhaust passageway portion 202) communicating between the exhaust outlet port 197 and the exhaust inlet port 196. The rear cover portion 318 forms a third section of the pattern assembly 10, which third section is mounted on the first section, covers the second section and is spaced from the second section so as to define the water jacket 102 between the second section and the third section.

Viewing the pattern assembly 10 another way, the base portion 138 forms a base section of the assembly 10, the right cylinder portions 150 and 174 form a first or right cylinder section, the left cylinder portions 162 and 206 form a second or left cylinder section, and the exhaust portions 262, 284 and 306 form an exhaust section. The left cylinder section is not directly connected to the right cylinder section. In other words, there are no mating surfaces between the cylinder sections. The cylinder sections are only indirectly connected, via the base and exhaust sections. This permits the cylinder sections to be properly positioned relative to the base and exhaust sections without having to be exactly positioned relative to each other.

It is important to note that the foam pattern assembly 10 comprises no non-parallel (or non-mating) intersecting glue surfaces. In other words, the only glue surfaces that "intersect" are the mating (and therefore parallel) glue surfaces. This greatly simplifies assembly of the foam pattern assembly 10.

Figure 32:
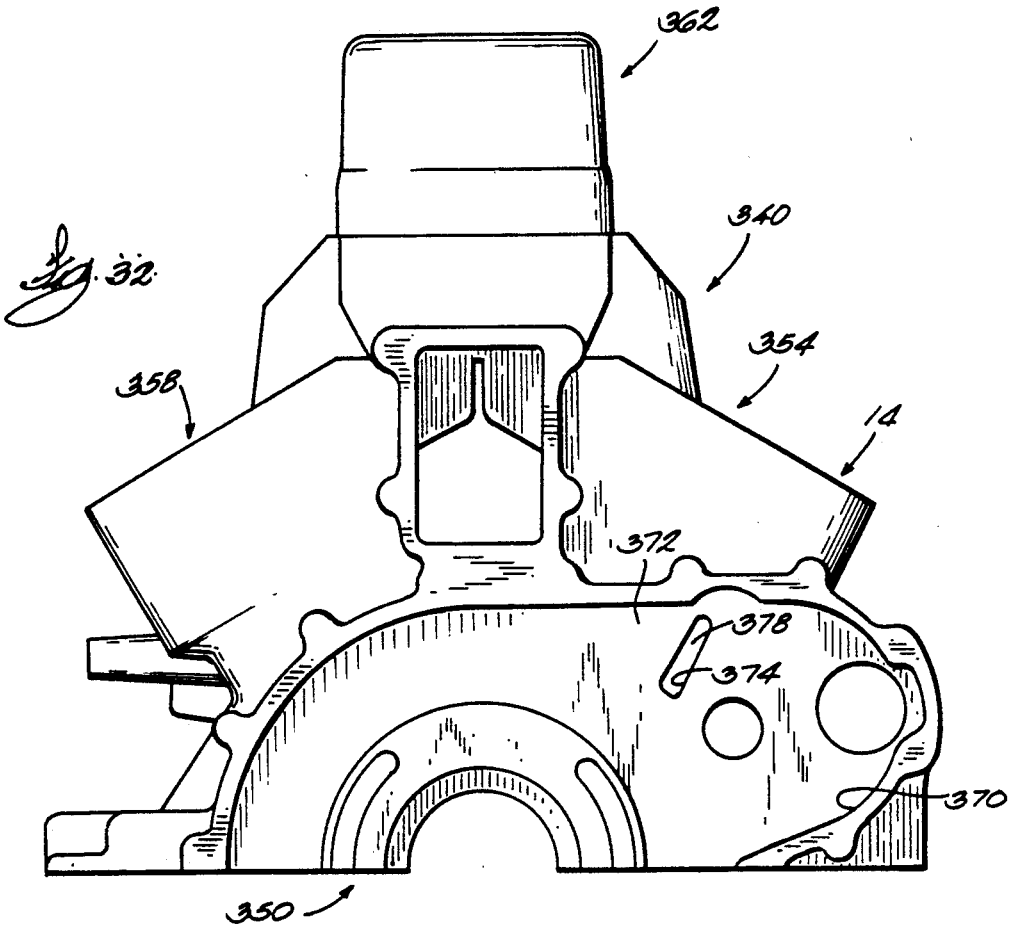
FIG. 32 is a partial top plan view of an engine block which results when the foam pattern assembly is used in a lost foam casting process.
Figure 25:
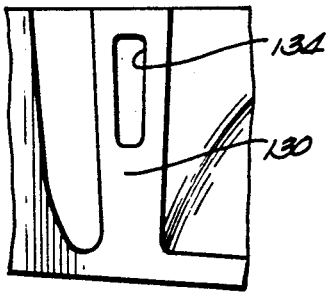
FIG. 25 is a view taken along line 25—25 in FIG. 17.
Figure 26:
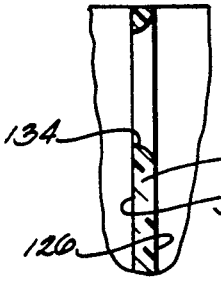
FIG. 26 is a view taken along line 26—26 in FIG. 17.
Figure 27:
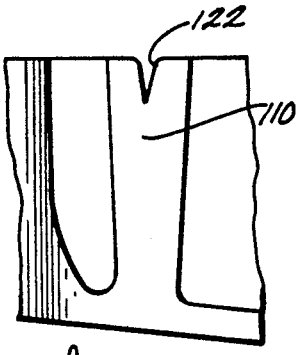
FIG. 27 is a view taken along line 27—27 in FIG. 17.
Figure 28:
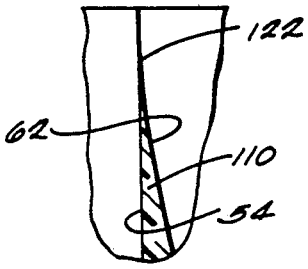
FIG. 28 is a view taken along line 28—28 in FIG. 17.
Figure 22:
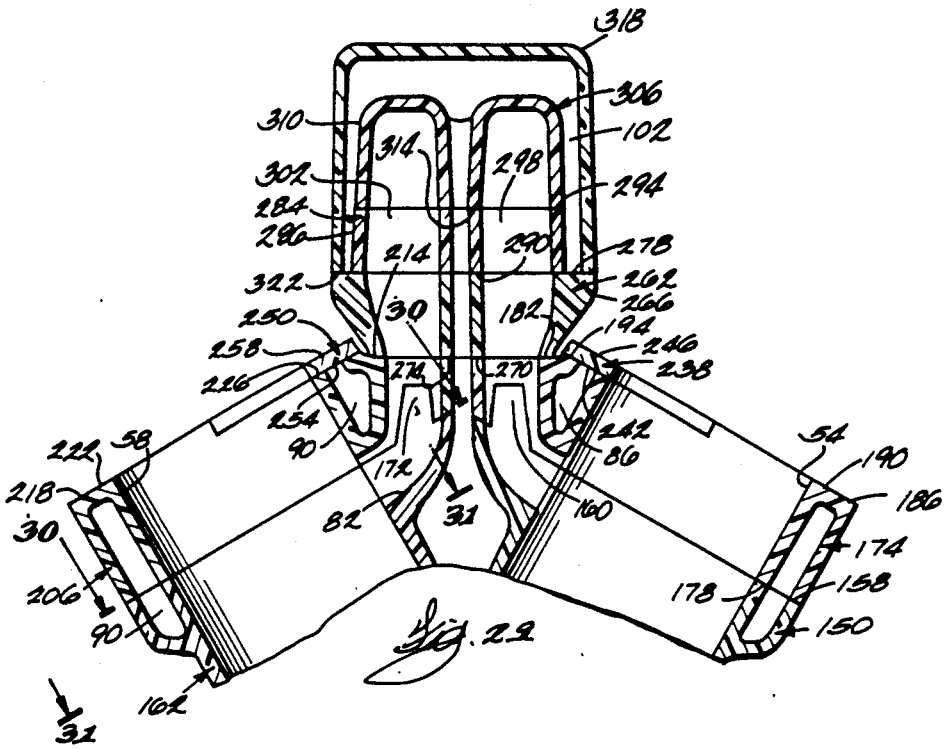
Figure 31:
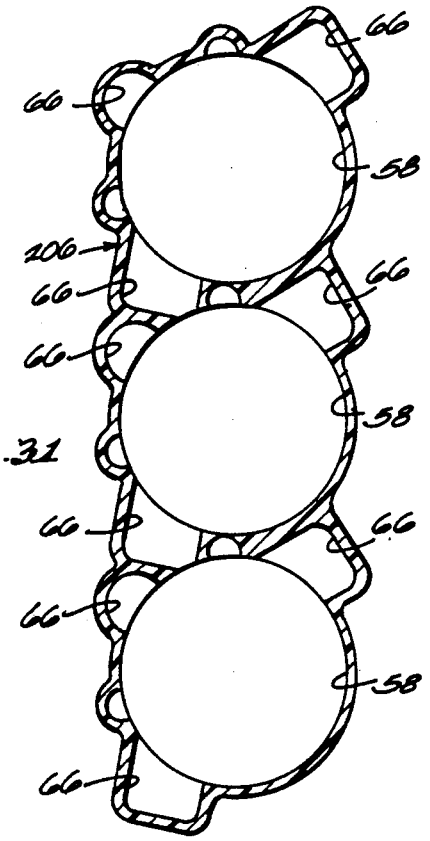
FIG. 31 is a view taken along line 31—31 in FIG. 29.
Figure 30:
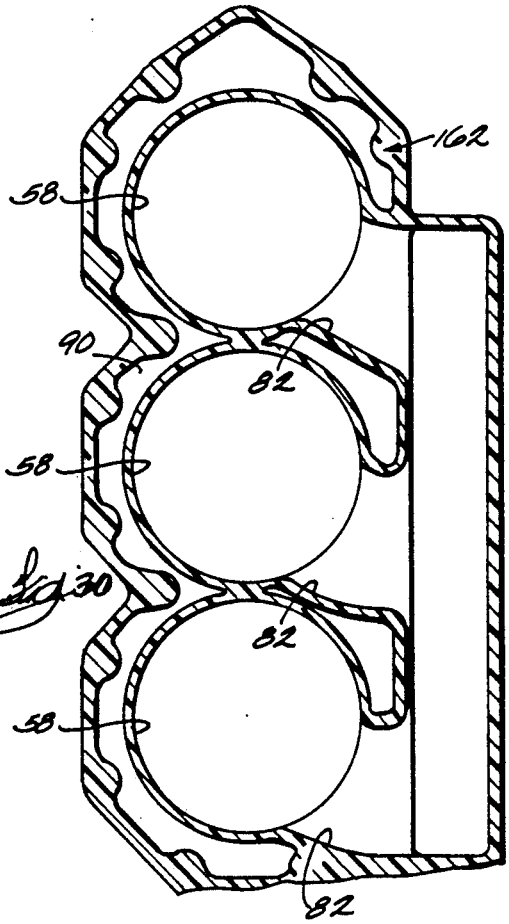
FIG. 30 is a view taken along line 30—30 in FIG. 29.

As mentioned above, the foam pattern assembly 10 is used in a lost foam casting process to form the engine block 14 (FIG. 32). While the foam pattern assembly 10 is being surrounded by sand, sand flows through the aperture 134 from the cavity 126 to the uppermost right cylinder bore 54.

Figure 34:
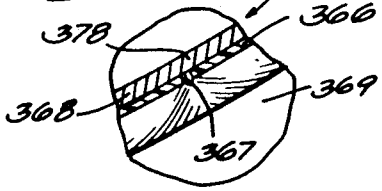
FIG. 34 is a partial sectional view of an internal combustion engine including the engine block.
Figure 14:
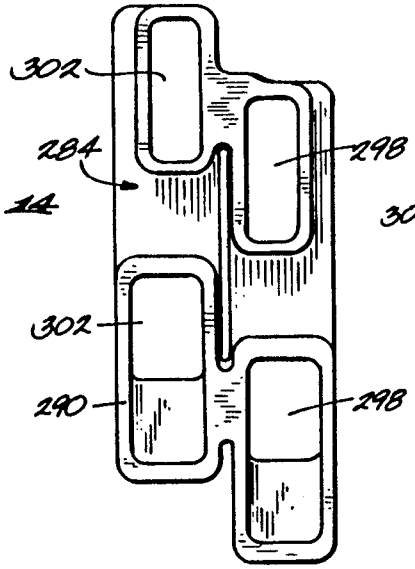
FIG. 14 is a front elevational view of the intermediate exhaust portion.
Figure 33:
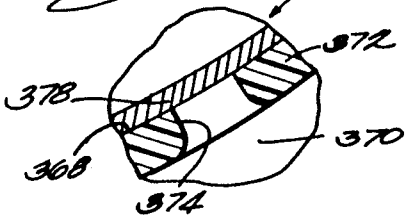
FIG. 33 is a partial sectional view of an internal combustion engine including the engine block.

An internal combustion engine 340 embodying the invention and including the engine block 14 which results when the foam pattern assembly 10 is used in a lost foam casting process is illustrated in FIGS. 33 and 34. The engine block 14 comprises a base portion 350 corresponding to the base portion 138 of the foam pattern assembly 10, a right cylinder bank 354 corresponding to the right front and rear cylinder portions 150 and 174 and to the right cover portion 238 of the foam pattern assembly 10, a left cylinder bank 358 corresponding to the left front and rear cylinder portions 162 and 206 and to the left cover portion 250 of the foam pattern assembly 10, and an exhaust portion 362 corresponding to the front, intermediate and rear exhaust portions 262, 284 and 306 and to the rear cover portion 318 of the pattern assembly 10. However, unlike the components of the foam pattern assembly 10, the base portion 350, the cylinder banks 354 and 358 and the exhaust portion 362 of the engine block 14 are integral and form a unitary engine block.

The engine block 14 comprises (see FIG. 34) a wall 366 which corresponds to the wall 106 of the foam pattern assembly 10, which has therein an aperture 367 corresponding to the associated aperture 122 of the pattern assembly 10 and which partially defines a cylinder bore 368 and an adjacent transfer passage 369. The engine block 14 also comprises walls (not shown) which correspond to the walls 110, 114 and 118 of the foam pattern assembly 10, which have therein apertures (not shown) corresponding to the associated apertures 122 of the assembly 10 and which partially define respective cylinder bores 368 and adjacent transfer passages 369. The engine block 14 also comprises (see FIG. 33) a cavity 370 corresponding to the cavity 126 of the assembly 10, and a wall 372 corresponding to the wall 130 of the assembly 10 and having therein a aperture 374 which corresponds to the aperture 134 of the assembly 10 and which communicates between a cylinder bore 368 and the cavity 370. Each of the apertures 367 and 374 constitutes an aperture communicating between a cylinder bore and an adjacent cavity.

The engine 340 is manufactured from the block 14, in part, as follows. First, the cylinder bores 368 are machined or ground to a final diameter which is greater than the diameter of the cylinder bores 368 immediately after casting of the engine block 14. This machining of the associated cylinder bore 368 removes a portion of the wall 366 and thereby enlarges the aperture 367 in the wall 366. Next, a suitable cylinder liner 378 (FIGS. 33 and 34) is inserted into each of the cylinder bores 368. The associated cylinder liner 378 closes the aperture 367, defines a cylinder and partially defines the transfer passage 369 that communicated with the aperture 367 prior to insertion of the cylinder liner 378. The associated cylinder liner 378 closes the aperture 374 and defines a cylinder.

Various features of the invention are set forth in the following claims.

I claim:

1. A foam pattern assembly for use in forming an engine block in a lost foam casting process, said pattern assembly comprising a base portion including a generally planar front surface having therein a plurality of crankcase-defining cavities and a plurality of intake ports, and a rear mounting surface spaced from said front surface, said base portion partially defining a plurality of transfer passages and a plurality of air intake passages each communicating with a respective one of said intake ports, and a cylinder portion including a generally planar front mounting surface mating with said rear mounting surface on said base portion, said cylinder portion partially defining said air intake passages and partially defining a plurality of cylinder bores each communicating with a respective one of said transfer passages.

2. A foam pattern assembly as set forth in claim 1 wherein each of said air intake passages communicates with one of a respective one of said crankcase-defining cavities, a respective one of said transfer passages, and both a respective one of said crankcase-defining cavities and a respective one of said transfer passages.

3. A foam pattern assembly as set forth in claim 1 wherein said cylinder portion includes a cavity adjacent one of said cylinder bores, and a wall partially defining said one of said cylinder bores and partially defining said cavity.

4. A foam pattern assembly as set forth in claim 3 wherein said wall is extremely thin.

5. A foam pattern assembly as set forth in claim 3 wherein said wall has therein an aperture communicating between said one of said cylinder bores an said cavity.

6. A foam pattern assembly as set forth in claim 5 wherein said aperture affords sand flow through said wall.

7. A foam pattern for use in forming an engine block in a lost foam casting process, said pattern comprising a base portion including a mounting surface having therein a plurality of crankcase-defining cavities, said base portion at least partially defining a plurality of air intake passages each communicating with a respective one of said crankcase-defining cavities.

8. A foam pattern for use in forming an engine block in a lost foam casting process, said pattern comprising a cylinder portion partially defining a plurality of cylinder bores, a plurality of transfer passages each communicating with a respective one of said cylinder bores, and a plurality of air intake passages each communicating with a respective one of said transfer passages.

9. A foam pattern assemblY for use in forming an engine block in a lost foam casting process, said pattern assembly comprising a base portion including a generally planar front surface having therein a plurality of crankcase-defining cavities, a first rear mounting surface spaced from said front surface, and a second rear mounting surface spaced from said front surface, a first front cylinder portion including a generally planar front mounting surface mating with said first rear mounting surface on said base portion, said first front cylinder portion partially defining a plurality of first cylinder bores each communicating with a respective one of said crankcase-defining cavities, and a second front cylinder portion spaced from said first front cylinder portion and including a generally planar front mounting surface mating with said second rear mounting surface on said base portion, said second front cylinder portion partially defining a plurality of second cylinder bores each communicating with a respective one of said crankcase-defining cavities.

10. A foam pattern assembly as set forth in claim 9 wherein said first front cylinder portion includes a cavity adjacent one of said first cylinder bores, and a wall partially defining said one of said first cylinder bores and partially defining said cavity.

11. A foam pattern assembly as set forth in claim 10 wherein said wall is extremely thin.

12. A foam pattern assembly as set forth in claim 11 wherein said wall has therein an aperture communicating between said one of said first cylinder bores and said cavity.

13. A foam pattern assembly as set forth in claim 12 wherein said aperture affords sand flow through said wall.

14. A foam pattern assembly for use in forming an engine block in a lost foam casting process, said pattern assembly comprising a cylinder bore, an adjacent cavity, and a wall partially defining said cylinder bore and said cavity and having therein an aperture communicating between said cylinder bore and said cavity.

15. A foam pattern assembly as set forth in claim 14 wherein said aperture affords sand flow through said wall.

16. A foam pattern assembly for use in forming an engine block in a lost foam casting process, said pattern assembly comprising a base portion including a generally planar front surface having therein a plurality of crankcase-defining cavities, a plurality of first intake ports and a plurality of second intake ports, a first rear mounting surface spaced from said front surface, and a second rear mounting surface spaced from said front surface, said base portion partially defining a plurality of first transfer passages, a plurality of second transfer passages, a plurality of first air intake passages each communicating between a respective one of said first intake ports and a respective one of said crankcase-defining cavities, and a plurality of second air intake passages each communicating between a respective one of said second intake ports and a respective one of said crankcase-defining cavities, a first front cylinder portion including a generally planar front mounting surface mating with said first rear mounting surface on said base portion, and a generally planar rear mounting surface spaced from said front mounting surface on said first front cylinder portion, said first front cylinder portion partially defining said first transfer passages, said first air intake passages, a plurality of first cylinder bores each communicating with a respective one of said first transfer passages, a plurality of first exhaust passages each communicating with a resPective one of said first cylinder bores, and a first water jacket located adjacent said first cylinder bores, a second front cylinder portion spaced from said first front cylinder portion and including a generally planar front mounting surface mating with said second rear mounting surface on said base portion, and a generally planar rear mounting surface spaced from said front mounting surface on said second front cylinder portion, said second front cylinder portion partially defining said second transfer passages, said second air intake passages, a plurality of second cylinder bores each communicating with a respective one of said second transfer passages, a plurality of second exhaust passages each communicating with a respective one of said second cylinder bores, and a second water jacket located adjacent said second cylinder bores, a first rear cylinder portion including a generally planar front mounting surface mating with said rear mounting surface on said first front cylinder portion, and inner and outer rear mounting surfaces spaced from said front mounting surface on said first rear cylinder portion, said first rear cylinder portion partially defining said first cylinder bores, said first exhaust passages, said first water jacket, a rear water jacket, a first upstream exhaust passageway communicating with said first exhaust passages, and a first downstream exhaust passageway, said first upstream exhaust passageway and said first downstream exhaust passageway intersecting said inner rear mounting surface on said first rear cylinder portion, a second rear cylinder portion including a generally planar front mounting surface mating with said rear mounting surface on said second front cylinder portion, and inner and outer rear mounting surfaces spaced from said front mounting surface on said second rear cylinder portion, said second rear cylinder portion partially defining said second cylinder bores, said second exhaust passages, said second water jacket, said rear water jacket, a second upstream exhaust passageway communicating with said second exhaust passages, and a second downstream exhaust passageway, said second upstream exhaust passageway and said second downstream exhaust passageway intersecting said inner rear mounting surface on said second rear cylinder portion, a first cover portion including a generally planar front mounting surface mating with said outer rear mounting surface on said first rear cylinder portion, said first cover portion partially defining said first cylinder bores and said first water jacket, a second cover portion including a generally planar front mounting surface mating with said outer rear mounting surface on said second rear cylinder portion, said second cover portion partially defining said second cylinder bores and said second water jacket, a front exhaust portion including a first front mounting surface mating with said inner rear mounting surface on said first rear cylinder portion, a second front mounting surface mating with said inner rear mounting surface on said second rear cylinder portion, and a rear mounting surface spaced from said front mounting surfaces on said front exhaust portion, said front exhaust portion partially defining said first and second upstream exhaust passageways, said rear water jacket, and said first and second downstream exhaust passageways, said rear water jacket, said first and second upstream exhaust passageways and said first and second downstream exhaust passageways intersecting said front and rear mounting surfaces on said front exhaust portion, an intermediate exhaust portion including a front mounting surface mating with said rear mounting surface on said front exhaust portion, and a rear mounting surface spaced from said front mounting surface on said intermediate exhaust portion, said intermediate exhaust portion partially defining said rear water jacket, a first intermediate exhaust passageway communicating between said first upstream exhaust passageway and said first downstream exhaust passageway, and a second intermediate exhaust passageway communicating between said second upstream exhaust passageway and said second downstream exhaust passageway, said first and second intermediate exhaust passageways intersecting said front and rear mounting surfaces on said intermediate exhaust portion, a rear exhaust portion including a front mounting surface mating with said rear mounting surface on said intermediate exhaust portion, said rear exhaust portion partially defining said rear water jacket, and said first and second intermediate exhaust passageways, said first and second intermediate exhaust passageways intersecting said front mounting surface on said rear exhaust portion, and a rear cover portion including a front mounting surface mating with said rear mounting surface on said front exhaust portion, said rear cover portion partially defining said rear water jacket.

17. A foam pattern assembly as set forth in claim 16 wherein said first front cylinder portion includes a cavity adjacent one of said first cylinder bores, and a wall partially defining said one of said first cylinder bores and partially defining said cavity.

18. A foam pattern assembly as set forth in claim 17 wherein said wall is extremely thin.

19. A foam pattern assembly as set forth in claim 17 wherein said wall has therein an aperture communicating between said one of said first cylinder bores and said cavity.

20. A foam pattern assembly as set forth in claim 19 wherein said aperture affords sand flow through said wall.

21. A foam pattern assembly as set forth in claim 16 wherein said first rear mounting surface on said base portion is disposed at an angle of approximately 45° relative to said front surface on said base portion, and wherein said second rear mounting surface on said base portion is disposed at an angle of approximately 45° relative to said front surface on said base portion and at an angle of approximately 90° relative to said first rear mounting surface.

22. A foam pattern assembly as set forth in claim 16 wherein said rear mounting surface on said first front cylinder portion is disposed at an angle of approximately 30° relative to said front surface on said base portion and at an angle of approximately 15° relative to said first rear mounting surface on said base portion, and wherein said rear mounting surface on said second front cylinder portion is disposed at an angle of approximately 30° relative to said front surface on said base portion and at an angle of approximately 15° relative to said second rear mounting surface on said base portion.

23. A foam pattern assembly as set forth in claim 16 wherein said rear mounting surface on said first rear cylinder portion extends generally parallel to said front mounting surface on said first rear cylinder portion, and wherein said rear mounting surface on said second rear cylinder portion extends generally parallel to said front mounting surface on said second rear cylinder portion.

24. A foam pattern assembly as set forth in claim 16 wherein said rear cover portion also includes an inner surface, wherein said front exhaust portion, said intermediate exhaust portion and said rear exhaust portion also include respective outer surfaces, and wherein said rear water jacket is located between said inner surface of said rear cover portion and said outer surfaces of said front exhaust portion, said intermediate exhaust portion and said rear exhaust portion.

25. A foam pattern assembly as set forth in claim 16 wherein said foam pattern assembly comprises no non-mating intersecting mounting surfaces.

26. A foam pattern assembly for use in forming an engine block in a lost foam casting process, said pattern assembly comprising a cylinder portion including a mounting surface and partially defining a cylinder bore and a water jacket intersecting said mounting surface, and a cover portion partially closing said water jacket and including a mounting surface mating with said mounting surface on said cylinder portion.

27. A foam pattern assembly for use in forming an engine block in a lost foam casting process, said pattern assembly comprising a first section at least partially defining a cylinder bore and including a mounting surface having therein an exhaust outlet port communicating with said cylinder bore, and an exhaust inlet port spaced from said exhaust outlet port, and a second section including a mounting surface mating with said first section mounting surface, said second section defining an exhaust passageway communicating between said exhaust outlet port and said exhaust inlet port.

28. An assembly as set forth in claim 27 wherein said second section includes a first pattern portion including a mounting surface and defining an upstream passageway portion communicating with said exhaust outlet port and a downstream passageway portion communicating with said exhaust inlet port, and wherein said second section also includes a second pattern portion including a mounting surface mating with said first pattern portion mounting surface, said second pattern portion defining an intermediate passageway portion communicating between said upstream passageway portion and said downstream passageway portion.

29. An assembly as set forth in claim 27 and further comprising a third section which is mounted on said first section, which covers said second section and which is spaced from said second section so as to define a water jacket between said second section and said third section.

30. An assembly as set forth in claim 27 wherein said first section also includes a second surface extending generally perpendicular to said first section mounting surface and having therein an exhaust outlet port, and wherein said first section defines an exhaust passageway extending between said exhaust inlet port and said second surface exhaust outlet port.

31. A foam pattern assembly for use in forming an engine block in a lost foam casting process, said pattern assembly having therein a cylinder, and an exhaust passage communicating with said cylinder and including a first, undercut portion preventing removal of a forming die from said exhaust passage in one direction, and a second portion permitting removal of a forming die from said exhaust passage in said one direction, said pattern assembly comprising a first pattern piece having therein a passage which defines said second portion of said exhaust passage and which permits removal of a forming die from said first pattern piece passage in said one direction, and a second pattern piece mating with said first pattern piece and including a projection which extends into said first pattern piece passage and which defines said undercut portion of said exhaust passage.

32. A pattern assembly as set forth in claim 31 wherein said undercut portion permits removal of a forming die from said second pattern piece in said opposite direction.

33. A pattern assembly as set forth in claim 31 wherein said one direction is the direction from said first piece toward said second piece.

34. A pattern assembly as set forth in claim 31 wherein said projection is spaced from said first pattern piece.

35. A pattern assembly as set forth in claim 31 wherein said projection is not glued to said first pattern piece.

36. A foam pattern assembly for use in forming an engine block in a lost foam casting process, said pattern assembly comprising a first portion including a mounting surface having therein an exhaust outlet port, a second portion including a first mounting surface mating with said first portion mounting surface, and a second mounting surface, said second portion defining a passageway Portion communicating with said exhaust outlet port, and a third portion including a mounting surface mating with said second mounting surface, said third portion defining a passageway communicating with said passageway of said second pattern portion.

37. A foam pattern assembly for use in forming an engine block in a lost foam casting process, said pattern assembly comprising a base section, a first cylinder section which is mounted on said base section and which partially defines a plurality of first cylinder bores, a second cylinder section which is mounted on said base section, which is not directly connected to said first cylinder section and which partially defines a plurality of second cylinder bores.

38. A foam pattern assembly as set forth in claim 37 and further comprising an exhaust section, and wherein said second cylinder section is indirectly connected to said first cylinder section via said exhaust section.

39. A foam pattern assembly comprising a first piece having therein a recess, and a second piece including a projection which extends into said recess and which is spaced from said first piece so that said projection is not glued to said first piece and does not contact said first piece.

40. A foam pattern assembly comprising a first piece including a first glue surface having therein a recess, and a second piece including a second glue surface having thereon a projection which extends into said recess and which is not glued to said first piece.

41. A foam pattern assembly as set forth in claim 40 wherein said projection is completely spaced from said first piece.

42. A foam pattern assembly for use in forming a V-type engine block in a lost foam casting process, said pattern assembly comprising a plurality of pattern portions each including at least one glue surface mating with a glue surface of another of said pattern portions, said pattern assembly comprising no non-parallel intersecting glue surfaces.

43. A foam pattern assembly as set forth in claim 43 and comprising a base portion including a front surface having thereon a pluralitY of crankcase-defining cavities, a first rear glue surface spaced from said front surface, a second rear glue surface spaced from said front surface and extending transversely to said first rear glue surface, and a third surface spaced from said front surface and extending between said first and second rear glue surfaces, a first cylinder portion including a front glue surface mating with said first rear glue surface on said base portion, and a second cylinder portion including a front glue surface mating with said second rear glue surface on said base portion.

44. A method for casting an engine block in a lost foam casting process, said method comprising the steps of providing a foam pattern comprising a base portion including a mounting surface having therein a plurality of crankcase-defining cavities, said base portion at least partially defining a plurality of air intake passages each communicating with a respective one of said crankcase-defining cavities and utilizing said foam pattern in a lost foam casting process to form an engine block.

45. A method for casting an engine block in a lost foam casting process, said method comprising the steps of providing a foam pattern comprising a cylinder portion partially defining a plurality of cylinder bores, a plurality of transfer passages each communicating with a respective one of said cylinder bores, and a plurality of air intake passages each communicating with a respective one of said transfer passage, and utilizing said foam pattern in a lost foam casting process to form an engine block.

46. A method for casting an engine block in a lost foam casting process, said method comprising the steps of providing a foam pattern assembly comprising a cylinder bore, an adjacent cavity, and a wall partially defining said cylinder bore and said cavity and having therein an aperture communicating between said cylinder bore and said cavity, and utilizing said foam pattern assembly in a lost foam casting process to form an engine block.

47. A method for casting an engine block according to claim 46 wherein said utilizing step includes the step of utilizing said pattern assembly in a lost foam casting process so that said flows through said aperture and so as to form an engine block including a cylinder bore, a wall and an aperture respectively corresponding to said cylinder bore, said wall and said aperture of said pattern assembly, and wherein said method further comprises the steps of providing a cylinder liner, and inserting said cylinder liner into said cylinder bore of said engine block so that said cylinder liner closes said aperture of said engine block and defines a cylinder.

48. A method for casting an engine block in a lost foam casting process, said method comprising the steps of providing a foam pattern assembly having therein a cylinder, and an exhaust passage communicating with said cylinder and including a first, undercut portion preventing removal of a forming die from said exhaust passage in one direction, and a second permitting removal of a forming die from said exhaust passage in said one direction, said pattern assembly comprising a first pattern piece having therein a passage which defines said second portion of said exhaust passage and which permits removal of a forming die from said first pattern piece passage in said one direction, and a second pattern piece mating with said first pattern piece and including a projection which extends into said first pattern piece passage and which defines said undercut portion of said exhaust passage, and utilizing said foam pattern assembly in a lost foam casting process to form an engine block.

49. A method for casting an engine block in a lost foam casting process, said method comprising the steps of providing a foam pattern assembly comprising a base section, a first cylinder section which is mounted on said base section and which partially defines a plurality of first cylinder bores, a second cylinder section which is mounted on said base section, which is not directly connected to said first cylinder section and which partially defines a plurality of second cylinder bores, and utilizing said foam pattern assembly in a lost foam casting process to form an engine block.

50. A method for casting a V-type engine block in a lost foam casting process, said method comprising the steps of providing a foam pattern assembly comprising a plurality of pattern portions each including at least one glue surface mating with a glue surface of another of said pattern portions, said pattern assembly comprising no non-parallel intersecting glue surfaces, and utilizing said foam pattern assembly in a lost foam casting process to form an engine block.

* * * * *